US008608909B2

(12) United States Patent
Scherb et al.

(10) Patent No.: US 8,608,909 B2
(45) **Date of Patent: *Dec. 17, 2013**

(54) ADVANCED DEWATERING SYSTEM

(75) Inventors: Thomas Thoröe Scherb, Sao Paulo (BR); Hubert Walkenhaus, Kerpen (DE); Jeffrey Herman, Bala Cynwyd, PA (US); Luiz Carlos Silva, Campo Limpo (BR)

(73) Assignee: Voith Patent GmbH, Heidenheim (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/303,804

(22) Filed: Nov. 23, 2011

(65) Prior Publication Data

US 2012/0061044 A1 Mar. 15, 2012

Related U.S. Application Data

(62) Division of application No. 12/731,737, filed on Mar. 25, 2010, now Pat. No. 8,236,140, which is a division of application No. 10/587,869, filed as application No. PCT/EP2005/050198 on Jan. 19, 2005, now Pat. No. 7,931,781.

(60) Provisional application No. 60/580,663, filed on Jun. 17, 2004, provisional application No. 60/581,500, filed on Jun. 21, 2004.

(51) Int. Cl.
*D21F 3/02* (2006.01)
*D21F 7/08* (2006.01)

(52) U.S. Cl.
USPC ..... 162/358.4; 162/358.1; 162/358.2; 34/95

(58) Field of Classification Search
USPC ..... 162/358.1, 358.3, 358.4, 900–903, 162/204–207, 363, 364, 367, 368, 348, 162/358.5, 359.1; 100/37, 121, 118, 151, 100/153; 34/122, 123
See application file for complete search history.

(56) References Cited

U.S. PATENT DOCUMENTS

| | | | | |
|---|---|---|---|---|
| 3,392,079 | A * | 7/1968 | Fekete | 428/113 |
| 4,162,190 | A | 7/1979 | Ashworth | |
| 4,346,138 | A * | 8/1982 | Lefferts | 428/222 |
| 4,440,597 | A | 4/1984 | Wells et al. | |

(Continued)

FOREIGN PATENT DOCUMENTS

| | | |
|---|---|---|
| DE | 19627891 A1 | 1/1998 |
| EP | 0658649 A1 | 6/1995 |

(Continued)

OTHER PUBLICATIONS

Coulter et al, "Vector Tri-Axial Press Fabric Design Improves Press Section Performance", 2003 TAPPI Spring Technical Conference Proceedings.*

(Continued)

*Primary Examiner* — Eric Hug
(74) *Attorney, Agent, or Firm* — Taylor IP, P.C.

(57) ABSTRACT

A permeable belt for use in a system for dewatering and/or drying a fibrous web. The permeable belt capable of being subjected to a tension of at least approximately 30 kN/m, the permeable belt having at least one side having an open area of at least approximately 25% and a contact area of at least approximately 10%.

16 Claims, 25 Drawing Sheets

(56) References Cited

U.S. PATENT DOCUMENTS

| | | | | |
|---|---|---|---|---|
| 5,580,423 | A * | 12/1996 | Ampulski et al. | 162/117 |
| 5,701,682 | A | 12/1997 | Chuang et al. | |
| 5,875,822 | A | 3/1999 | Fargeout | |
| 6,051,105 | A | 4/2000 | Ampulski | |
| 6,096,169 | A | 8/2000 | Hermans et al. | |
| 6,140,260 | A | 10/2000 | Johnson et al. | |
| 6,149,767 | A | 11/2000 | Hermans et al. | |
| 6,237,644 | B1 | 5/2001 | Hay et al. | |
| 6,436,240 | B1 | 8/2002 | Jeffrey | |
| 6,454,904 | B1 | 9/2002 | Hermans et al. | |
| 7,005,045 | B1 * | 2/2006 | Halmschlager et al. | 162/375 |
| 7,294,237 | B2 | 11/2007 | Herman et al. | |
| 7,351,307 | B2 * | 4/2008 | Scherb et al. | 162/115 |
| 7,476,293 | B2 * | 1/2009 | Herman et al. | 162/206 |
| 7,476,294 | B2 | 1/2009 | Herman et al. | |
| 7,510,631 | B2 * | 3/2009 | Scherb et al. | 162/358.1 |
| 7,927,462 | B2 * | 4/2011 | Scherb et al. | 162/358.3 |
| 7,931,781 | B2 * | 4/2011 | Scherb et al. | 162/358.5 |
| 7,951,269 | B2 * | 5/2011 | Herman et al. | 162/358.3 |
| 8,075,739 | B2 * | 12/2011 | Scherb et al. | 162/358.5 |
| 8,236,140 | B2 * | 8/2012 | Scherb et al. | 162/358.3 |
| 8,382,956 | B2 * | 2/2013 | Boechat et al. | 162/358.1 |
| 2002/0099347 | A1 | 7/2002 | Chen et al. | |
| 2003/0033727 | A1 | 2/2003 | Stelljes, Jr. et al. | |
| 2003/0051848 | A1 | 3/2003 | Watanabe | |
| 2003/0056919 | A1 | 3/2003 | Beck | |
| 2003/0056925 | A1 | 3/2003 | Beck | |
| 2003/0066935 | A1 | 4/2003 | Enqvist | |

FOREIGN PATENT DOCUMENTS

| | | | |
|---|---|---|---|
| EP | 0695827 | A2 | 2/1996 |
| EP | 0878579 | A2 | 11/1998 |
| EP | 1293602 | A1 | 3/2003 |
| RU | 2243305 | C2 | 4/2004 |
| WO | 03062528 | A1 | 7/2003 |

OTHER PUBLICATIONS

Office Action from Russian Patent Office regarding Russian Application No. 2006131134/12 (033844).

Decision on grant from Russian Patent Office, dated Jan. 21, 2009.

Office Action from Russian Patent Office regarding Russian Application No. 2006131134/12 (033844); dated Oct. 23, 2008.

* cited by examiner

ADVANCED DEWATERING SYSTEM

CROSS REFERENCE TO RELATED APPLICATIONS

This is a division of U.S. patent application Ser. No. 12/731,737, entitled "ADVANCED DEWATERING SYSTEM", filed Mar. 25, 2010, now U.S. Pat. No. 8,236,140, which is incorporated herein by reference. The above noted application was a division of U.S. patent application Ser. No. 10/587,869, entitled "ADVANCED DEWATERING SYSTEM", filed Jul. 28, 2006 Apr. 27, 2007, now U.S. Pat. No. 7,931,781, which is a 371 application of PCT/EP05/50198, filed on Jan. 19, 2005, and which claims the benefit of U.S. provisional application No. 60/580,663, filed on Jun. 17, 2004, and of U.S. provisional application No. 60/581,500, filed on Jun. 21, 2004.

BACKGROUND OF THE INVENTION

1. Field of the Invention

The present invention relates to a paper machine, and, more particularly, to an advanced dewatering system of a paper machine.

2. Description of the Related Art

In a wet pressing operation, a fibrous web sheet is compressed at a press nip to the point where hydraulic pressure drives water out of the fibrous web. It has been recognized that conventional wet pressing methods are inefficient in that only a small portion of a roll's circumference is used to process the paper web. To overcome this limitation, some attempts have been made to adapt a solid impermeable belt to an extended nip for pressing the paper web and dewater the paper web. A problem with such an approach is that the impermeable belt prevents the flow of a drying fluid, such as air through the paper web. Extended nip press (ENP) belts are used throughout the paper industry as a way of increasing the actual pressing dwell time in a press nip. A shoe press is the apparatus that provides the ability of the ENP belt to have pressure applied therethrough, by having a stationary shoe that is configured to the curvature of the hard surface being pressed, for example, a solid press roll. In this way, the nip can be extended 120 mm for tissue, up to 250 mm for flat papers beyond the limit of the contact between the press rolls themselves. An ENP belt serves as a roll cover on the shoe press. This flexible belt is lubricated on the inside by an oil shower to prevent frictional damage. The belt and shoe press are non-permeable members and dewatering of the fibrous web is accomplished almost exclusively by the mechanical pressing thereof.

It is known in the prior art to utilize a through air drying process (TAD) for drying webs, especially tissue webs to reduce mechanical pressing. Huge TAD-cylinders are necessary, however, and as well as a complex air supply and heating system. This system requires a high operating expense to reach the necessary dryness of the web before it is transferred to a Yankee Cylinder, which drying cylinder dries the web to its end dryness of approximately 96%. On the Yankee surface, also, the creping takes place through a creping doctor.

The machinery of the TAD system is a very expensive and costs roughly double that of a conventional tissue machine. Also, the operational costs are high, because with the TAD process, it is necessary to dry the web to a higher dryness level than it would be appropriate with the through air system in respect of the drying efficiency. The reason therefore is the poor CD moisture profile produced by the TAD system at low dryness level. The moisture CD profile is only acceptable at high dryness levels up to 60%. At over 30%, the impingement drying by the Hood/Yankee is much more efficient.

The max web quality of a conventional tissue manufacturing process are as follows: the bulk of the produced tissue web is less than 9 $cm^3/g$. The water holding capacity (measured by the basket method) of the produced tissue web is less than 9 (g H20/g fiber).

WO 03/062528 (and corresponding published US patent application No. US 2003/0136018, whose disclosures are hereby expressly incorporated by reference in their entireties), for example, disclose a method of making a three dimensional surface structured web wherein the web exhibits improved caliper and absorbency. This document discusses the need to improve dewatering with a specially designed advanced dewatering system. The system uses a Belt Press, which applies a load to the back side of the structured fabric during dewatering. The structured fabric is permeable and can be a permeable ENP belt in order to promote vacuum and pressing dewatering simultaneously. However, such a system has disadvantages such as a limited open area.

The wet molding process disclosed in WO 03/062528 speaks to running a structured fabric in the standard Crescent Former press fabric position as part of the manufacturing process for making a three dimensional surface structured web.

What is needed in the art is a method and apparatus to effectively dewater a fibrous web.

SUMMARY OF THE INVENTION

The present invention aims to improve the overall efficiency of the drying process, so that higher machine speeds can be realized and can be closer to the speeds of existing TAD machines. The invention also provides for an increased pressure field 3, i.e., a main drying region of a press arrangement, so that the sheet or web exiting this region ex its with a sheet solids level in a way that does not negatively impact sheet quality.

To achieve the desired dryness, in accordance with an advantageous embodiment of the method disclosed therein, at least one felt with a foamed layer wrapping a suction roll is used for dewatering the web. In this connection, the foam coating can in particular be selected such that the mean pore size in a range from approximately 3 to approximately 6 μm results. The corresponding capillary action is therefore utilized for dewatering. The felt is provided with a special foam layer, which gives the surface very small pores whose diameters can lie in the range set forth from approximately 3 to approximately 6 μm. The air permeability of this felt is very low. The natural capillary action is used for dewatering the web while this is in contact with the felt.

In accordance with an advantageous embodiment of the method disclosed therein, a so-called SPECTRA membrane is used for dewatering the web, said SPECTRA membrane preferably being laminated or otherwise attached to an air distribution layer, and with this SPECTRA membrane preferably being used together with a conventional, in particular, woven, fabric. This document also discloses the use of an anti-rewetting membrane.

The inventors have shown, that these suggested solutions, especially the use of the specially designed dewatering fabrics, improve the dewatering process, but the gains were not sufficient to support high speed operation. What is needed is a more efficient dewatering system, which is the subject of this disclosure.

The invention thus relates to an Advanced Dewatering System (ADS). It also relates to a method and apparatus for drying a web, especially a tissue or hygiene web, which utilizes any number of related fabrics. It also utilizes a permeable fabric and/or a permeable Extended Nip Press (ENP) belt that rides over a drying apparatus (such as, e.g., suction roll). The system utilizes pressure as well as a dewatering fabric, which can be used to dewater the web around a suction roll. Such features are utilized in new ways to manufacture a high quality tissue or hygiene web.

The permeable extended nip press (ENP) belt may include at least one spiral link belt. An open area of the at least one spiral link fabric may be between approximately 30% and approximately 85%, and a contact area of the at least one spiral link fabric may be between approximately 15% and approximately 70%. The open area may be between approximately 45% and approximately 85%, and the contact area may be between approximately 15% and approximately 55%. The open area may be between approximately 50% and approximately 65%, and the contact area may be between approximately 35% and approximately 50%.

At least one main aspect of the invention is a method for dewatering a sheet. The sheet is carried into a main pressure field on a structured fabric where it comes in contact with a special designed dewatering fabric that is running around and/or over a suction device (e.g., around a suction roll). A negative pressure is applied to the back side of the dewatering fabric such that the air flows first through the structured fabric then through the web, and then through the special designed dewatering fabric into suction device.

Non-limiting examples or aspects of the dewatering fabric are as follows. One preferred structure is a traditional needle punched press fabric, with multiple layers of batt fiber, wherein the batt fiber ranges from between approximately 0.5 dtex to approximately 22 dtex. The dewatering fabric can include a combination of different dtex fibers. It can also preferably contain an adhesive to supplement fiber to fiber or fiber to substructure (base cloth) or particle to fiber or particle to substructure (base cloth) bonding, for example, low melt fibers or particles, and/or resin treatments. Acceptable bonding with melting fibers can be achieved by using adhesive, which is equal to or greater than approximately 1% of the total cloth weight, preferably equal to or greater than approximately 3%, and most preferably equal to or greater than approximately 5%. These melting fibers, for example, can be made from one component or can contain two or more components. All of these fibers can have different shapes and at least one of these components can have an essentially lower melting point than the standard material for the cloth. The dewatering fabric may be a thin structure, which is preferably less than approximately 1.50 mm thick, or more preferably less than approximately 1.25 mm, and most preferably less than approximately 1.0 mm. The dewatering fabric can include weft yarns which can be multifilament yarns usually twisted/plied. The weft yarns can also be solid mono strands usually less than approximately 0.30 mm diameter, preferably approximately 0.20 mm in diameter, or as low as approximately 0.10 mm in diameter. The weft yarns can be a single strand, twisted or cabled, or joined side by side, or a flat shape. The dewatering fabric can also utilize warp yarns which are monofilament and which have a diameter of between approximately 0.30 mm and approximately 0.10 mm. They may be twisted or single filaments, which can preferably be approximately 0.20 mm in diameter. The dewatering fabric can be needled punched with straight through drainage channels, and may preferably utilize a generally uniform needling. The dewatering fabric can also include an optional thin hydrophobic layer applied to one of its surfaces with, e.g., an air perm of between approximately 5 to approximately 100 cfm, and preferably approximately 19 cfm or higher, most preferably approximately 35 cfm or higher. The mean pore diameter can be in the range of between approximately 5 to approximately 75 microns, preferably approximately 25 microns or higher, more preferably approximately 35 microns or higher. The dewatering fabric can be made of various synthetic polymeric materials, or even wool, etc., and can preferably be made of polyamides such as, e.g., Nylon 6.

An alternative structure for the dewatering fabric can be a woven base cloth laminated to an anti-rewet layer. The base cloth is woven endless structure using between approximately 0.10 mm and approximately 0.30 mm, and preferably approximately 0.20 mm diameter monofilament warp yarns (cross machine direction yarns on the paper machine) and a combination multifilament yarns usually twisted/plied. The yarns can also be solid mono strands usually less than approximately 0.30 mm diameter, preferably approximately 0.20 mm in diameter, or as low as approximately 0.10 mm in diameter. The weft yarns can be a single strand, twisted or cabled, joined side by side, or a flat shape weft (machine direction yarns on the paper machine). The base fabric can be laminated to an anti-rewet layer, which preferably is a thin elastomeric cast permeable membrane. The permeable membrane can be approximately 1.05 mm thick, and preferably less than approximately 1.05 mm. The purpose of the thin elastomeric cast membrane is to prevent sheet rewet by providing a buffer layer of air to delay water from traveling back into the sheet, since the air needs to be moved before the water can reach the sheet. The lamination process can be accomplished by either melting the elastomeric membrane into the woven base cloth, or by needling two or less thin layers of batt fiber on the face side with two or less thin layers of batt fiber on the back side to secure the two layers together. An optional thin hydrophobic layer can be applied to the surface. This optional layer can have an air perm of approximately 130 cfm or lower, preferably approximately 100 cfm or lower, and most preferably approximately 80 cfm or lower. The belt may have a mean pore diameter of approximately 140 microns or lower, more preferably approximately 100 microns or lower, and most preferably approximately 60 microns or lower.

Another alternative structure for the dewatering fabric utilizes an anti-rewet membrane which includes a thin woven multifilament textile cloth laminated to a thin perforated hydrophobic film, with an air perm of 35 cfm or less, preferably 25 cfm or less, with a mean pore size of 15 microns. According to a further preferred embodiment of the invention, the dewatering fabric is a felt with a batt layer. The diameter of the batt fibers of the lower fabric are equal to or less than approximately 11 dtex, and can preferably be equal to or lower than approximately 4.2 dtex, or more preferably be equal to or less than approximately 3.3 dtex. The batt fibers can also be a blend of fibers. The dewatering fabric can also contain a vector layer which contains fibers from approximately 67 dtex, and can also contain even courser fibers such as, e.g., approximately 100 dtex, approximately 140 dtex, or even higher dtex numbers. This is important for the good absorption of water. The wetted surface of the batt layer of the dewatering fabric and/or of the dewatering fabric itself can be equal to or greater than approximately 35 $m^2/m^2$ felt area, and can preferably be equal to or greater than approximately 65 $m^2/m^2$ felt area, and can most preferably be equal to or greater than approximately 100 $m^2/m^2$ felt area. The specific surface of the dewatering fabric should be equal to or greater than approximately 0.04 $m^2/g$ felt weight, and can preferably be equal to or greater than approximately 0.065 $m^2/g$ felt weight, and can most preferably be equal to or greater than approximately 0.075 $m^2/g$ felt weight. This is important for the good absorption of water. The dynamic stiffness K*[N/mm] as a value for the compressibility is acceptable if less than or equal to 100,000 N/mm, preferable compressibility is less than or equal to 90,000 N/mm, and most preferably the compressibility is less than or equal to 70,000 N/mm. The compressibility (thickness change by force in mm/N) of the dewatering fabric is higher than that of the upper fabric. This is also important in order to dewater the web efficiently to a high dryness level.

The dewatering fabric may also preferably utilize vertical flow channels. These can be created by printing polymeric materials onto the fabric. They can also be created by a special weave pattern which uses low melt yarns that are subsequently thermoformed to create channels and air blocks to prevent leakage. Such structures can be needle punched to provide surface enhancements and wear resistance.

The fabrics used for the dewatering fabric can also be seamed/joined on the machine socked on when the fabrics are already joined. The on-machine seamed/joined method does not interfere with the dewatering process.

The surface of the dewatering fabrics described in this application can be modified to alter surface energy. They can also have blocked in-plane flow properties in order to force exclusive z-direction flow.

The invention also provides for system for drying a tissue or hygiene web, wherein the system includes a permeable structured fabric carrying the web over a drying apparatus, a permeable dewatering fabric contacting the web and being guided over the drying apparatus, and a mechanism for applying pressure to the permeable structured fabric, the web, and the permeable dewatering fabric at the drying apparatus.

The invention also takes advantage of the fact that the mass of fibers remain protected within the body (valleys) of the structured fabric and there is only a slightly pressing, which occurs between the prominent points of the structured fabric (valleys). These valleys are not too deep so as to avoid deforming the fibers of the sheet plastically and to avoid negatively impacting the quality of the paper sheet, but no so shallow so as to take-up the excess water out of the mass of fibers. Of course, this is dependent on the softness, compressibility and resilience of the dewatering fabric.

The permeable structured fabric may include a permeable Extended Nip Press (ENP) belt and the drying apparatus may include a suction or vacuum roll. The drying apparatus may include a suction roll. The drying apparatus may include a suction box. The drying apparatus may apply a vacuum or negative pressure to a surface of the permeable dewatering fabric, which is opposite to a surface of the permeable dewatering fabric that contacts the web. The system may be structured and arranged to cause an air flow first through the permeable structured fabric, then through the web, then through the permeable dewatering fabric and into drying apparatus.

The permeable dewatering fabric may include a needle punched press fabric with multiple layers of batt fiber. The permeable dewatering fabric mat includes a needle punched press fabric with multiple layers of batt fiber, and wherein the batt fiber ranges from between approximately 0.5 dtex to approximately 22 dtex. The permeable dewatering fabric may include a combination of different dtex fibers. According to a further preferred embodiment of the invention, the permeable dewatering fabric is a felt with a batt layer. The diameter of the batt fibers of the lower fabric are equal to or less than approximately 11 dtex, and can preferably be equal to or lower than approximately 4.2 dtex, or more preferably be equal to or less than approximately 3.3 dtex. The batt fibers can also be a blend of fibers. The permeable dewatering fabric can also contain a vector layer which contains fibers from approximately 67 dtex, and can also contain even courser fibers such as, e.g., approximately 100 dtex, approximately 140 dtex, or even higher dtex numbers. This is important for the good absorption of water. The wetted surface of the batt layer of the permeable dewatering fabric and/or of the permeable dewatering fabric itself can be equal to or greater than approximately 35 $m^2/m^2$ felt area, and can preferably be equal to or greater than approximately 65 $m^2/m^2$ felt area, and can most preferably be equal to or greater than approximately 100 $m^2/m^2$ felt area. The specific surface of the permeable dewatering fabric should be equal to or greater than approximately 0.04 $m^2/g$ felt weight, and can preferably be equal to or greater than approximately 0.065 $m^2/g$ felt weight, and can most preferably be equal to or greater than approximately 0.075 $m^2/g$ felt weight. This is important for the good absorption of water. The dynamic stiffness K*[N/mm] as a value for the compressibility is acceptable if less than or equal to 100,000 N/mm, preferable compressibility is less than or equal to 90,000 N/mm, and most preferably the compressibility is less than or equal to 70,000 N/mm. The compressibility (thickness change by force in mm/N) of the permeable dewatering fabric is higher than that of the upper fabric. This is also important in order to dewater the web efficiently to a high dryness level.

The permeable dewatering fabric may include batt fibers and an adhesive to supplement fiber to fiber bonding. The permeable dewatering fabric may include batt fibers, which include at least one of low melt fibers or particles and resin treatments. The permeable dewatering fabric may include a thickness of less than approximately 1.50 mm thick. The permeable dewatering fabric may include a thickness of less than approximately 1.25 mm thick. The permeable dewatering fabric may include a thickness of less than approximately 1.00 mm thick.

The permeable dewatering fabric may include weft yarns. The weft yarns may include multifilament yarns, which are twisted or plied. The weft yarns may include solid mono strands, which are less than approximately 0.30 mm diameter. The weft yarns may include solid mono strands, which are less than approximately 0.20 mm diameter. The weft yarns may include solid mono strands, which are less than approximately 0.10 mm diameter. The weft yarns may include one of single strand yarns, twisted yarns, cabled yarns, yarns that are joined side by side, and yarns that are generally flat shaped.

The permeable dewatering fabric may include warp yarns. The warp yarns may include monofilament yarns having a diameter of between approximately 0.30 mm and approximately 0.10 mm. The warp yarns may include twisted or single filaments, which are approximately 0.20 mm in diameter. The permeable dewatering fabric may be needled punched and may include straight through drainage channels. The permeable dewatering fabric may be needled punched and utilizes a generally uniform needling. The permeable dewatering fabric may include a base fabric and a thin hydrophobic layer applied to a surface of the base fabric. The permeable dewatering fabric may include an air permeability of between approximately 5 to approximately 100 cfm. The permeable dewatering fabric may include an air permeability which is approximately 19 cfm or higher. The permeable dewatering fabric may include an air permeability which is approximately 35 cfm or higher. The permeable dewatering fabric may include a mean pore diameter in the range of between approximately 5 to approximately 75 microns. The permeable dewatering fabric may include a mean pore diameter which is approximately 25 microns or higher. The permeable dewatering fabric may include a mean pore diameter which is approximately 35 microns or higher.

The permeable dewatering fabric may include at least one synthetic polymeric material. The permeable dewatering fabric may include wool. The permeable dewatering fabric may include a polyamide material. The polyamide material may be Nylon 6 also known as polycaprolactam. The permeable dewatering fabric may include a woven base cloth, which is laminated to an anti-rewet layer. The woven base cloth may include a woven endless structure, which includes monofilament warp yarns having a diameter of between approximately 0.10 mm and approximately 0.30 mm. The diameter may be approximately 0.20 mm. The woven base cloth may include a woven endless structure, which includes multifilament yarns, which are twisted or plied. The woven base cloth may include a woven endless structure, which includes multifilament yarns, which are solid mono strands of less than approximately 0.30 mm diameter. The solid mono strands may be approximately 0.20 mm diameter. The solid mono strands may be approximately 0.10 mm diameter.

The woven base cloth may include a woven endless structure, which includes weft yarns. The weft yarns may include one of single strand yarns, twisted or cabled yarns, yarns that are joined side by side, and flat shape weft yarns. The permeable dewatering fabric may include a base fabric layer and an anti-rewet layer. The anti-rewet layer may include a thin elastomeric cast permeable membrane. The elastomeric cast permeable membrane may be equal to or less than approximately 1.05 mm thick. The elastomeric cast permeable membrane may be adapted to form a buffer layer of air so as to delay water from traveling back into the web. The anti-rewet layer and the base fabric layer may be connected to each other by lamination.

The invention also provides for a method of connecting the anti-rewet layer and the base fabric layer described above, wherein the method includes melting a thin elastomeric cast permeable membrane into the base fabric layer. The invention also provides for a method of connecting the anti-rewet layer and the base fabric layer of type described above, wherein the method includes needling two or less thin layers of batt fiber on a face side of the base fabric layer with two or less thin layers of batt fiber on a back side of the base fabric layer. The method may further include connecting a thin hydrophobic layer to at least one surface.

The invention also provides for a system for drying a web, wherein the system includes a permeable structured fabric carrying the web over a vacuum roll, a permeable dewatering fabric contacting the web and being guided over the vacuum roll, and a mechanism for applying pressure to the permeable structured fabric, the web, and the permeable dewatering fabric at the vacuum roll.

The mechanism may include a hood that produces an overpressure. The mechanism may include a belt press. The belt press may include a permeable belt. The invention also provides for a method of drying a web using the system described above, wherein the method includes moving the web on the permeable structured fabric over the vacuum roll, guiding the permeable dewatering fabric in contact with the web over the vacuum roll, applying mechanical pressure to the permeable structured fabric, the web, and the permeable dewatering fabric at the vacuum roll, and suctioning during the applying, with the vacuum roll, the permeable structured fabric, the web, and the permeable dewatering fabric.

Rather than relying on a mechanical shoe for pressing, the invention allows for the use a permeable belt as the pressing element. The belt is tensioned against a suction roll so as to form a Belt Press. This allows for a much longer press nip, i.e., approximately ten times longer, which results in a much lower peak pressures, i.e., approximately 20 times lower. It also has the great advantage of allowing air flow through the web, and into the press nip itself, which is not the case with typical Shoe Presses. With the low peak pressure with the air flow and the soft surface of the dewatering fabric, a slight pressing and dewatering occurs also in the protected area between the prominent points of the structured fabric, but not so deep so as to avoid deforming the fibrous sheet plastically and avoiding a reduction in sheet quality.

The present invention also provides for a specially designed permeable ENP belt, which can be used on a Belt Press in an advanced dewatering system or in an arrangement wherein the web is formed over a structured fabric. The permeable ENP belt can also be used in a No Press/Low press Tissue Flex process and with a link fabric.

The present invention also provides a high strength permeable press belt with open areas and contact areas on a side of the belt.

The invention comprises, in one form thereof, a belt press including a roll having an exterior surface and a permeable belt having a side in pressing contact over a portion of the exterior surface of the roll. The permeable belt having a tension of at least approximately 30 KN/m applied thereto. The side of the permeable belt having an open area of at least approximately 25%, and a contact area of at least approximately 10%, preferably of at least 25%.

An advantage of the present invention is that it allows substantial airflow therethrough to reach the fibrous web for the removal of water by way of a vacuum, particularly during a pressing operation.

Another advantage is that the permeable belt allows a significant tension to be applied thereto.

Yet another advantage is that the permeable belt has substantial open areas adjacent to contact areas along one side of the belt.

Still yet another advantage of the present invention is that the permeable belt is capable of applying a line force over an extremely long nip, thereby ensuring a much long dwell time in which pressure is applied against the web as compared to a standard shoe press.

The invention also provides for a belt press for a paper machine, wherein the belt press includes a roll including an exterior surface. A permeable belt includes a first side and being guided over a portion of the exterior surface of the roll. The permeable belt has a tension of at least approximately 30 KN/m. The first side has an open area of at least approximately 25% a contact area of at least approximately 10%, preferably of at least approximately 25%.

The first side may face the exterior surface and the permeable belt may exert a pressing force on the roll. The permeable belt may include through openings. The permeable belt may include through openings arranged in a generally regular symmetrical pattern. The permeable belt may include generally parallel rows of through openings, whereby the rows are oriented along a machine direction. The permeable belt may exert a pressing force on the roll in the range of between approximately 30 KPa and approximately 150 KPa. The permeable belt may include through openings and a plurality of grooves, each groove intersecting a different set of through openings. The first side may face the exterior surface and the permeable belt may exert a pressing force on the roll. The plurality of grooves may be arranged on the first side. Each of the plurality of grooves may include a width, and each of the through openings may include a diameter, and wherein the diameter is greater than the width.

The tension of the belt is greater than approximately 50 KN/m. The roll may include a vacuum roll. The roll may include a vacuum roll having an interior circumferential portion. The vacuum roll may include at least one vacuum zone arranged within said interior circumferential portion. The roll may include a vacuum roll having a suction zone. The suction zone may include a circumferential length of between approximately 200 mm and approximately 2,500 mm. The circumferential length may be in the range of between approximately 800 mm and approximately 1,800 mm. The circumferential length may be in the range of between approximately 1,200 mm and approximately 1,600 mm. The permeable belt may include at least one of a polyurethane extended nip belt and a spiral link fabric. The permeable belt may include a polyurethane extended nip belt, which includes a plurality of reinforcing yarns embedded therein. The plurality of reinforcing yarns may include a plurality of machine direction yarns and a plurality of cross direction yarns. The permeable belt may include a polyurethane extended nip belt having a plurality of reinforcing yarns embedded therein, said plurality of reinforcing yarns being woven in a spiral link manner. The permeable belt may include a spiral link fabric.

The belt press may further include a first fabric and a second fabric traveling between the permeable belt and the roll. The first fabric has a first side and a second side. The first side of the first fabric is in at least partial contact with the exterior surface of the roll. The second side of the first fabric is in at least partial contact with a first side of a fibrous web. The second fabric has a first side and a second side. The first side of the second fabric is in at least partial contact with the first side of the permeable belt. The second side of the second fabric is in at least partial contact with a second side of the fibrous web.

The first fabric may include a permeable dewatering belt. The second fabric may include a structured fabric. The fibrous web may include a tissue web or hygiene web. The invention also provides for a fibrous material drying arrangement including an endlessly circulating permeable extended nip press (ENP) belt guided over a roll. The ENP belt is subjected to a tension of at least approximately 30 KN/m. The ENP belt includes a side having an open area of at least approximately 25% and a contact area of at least approximately 10%, preferably of at least approximately 25%. The first fabric can also be a link fabric.

The invention also provides for a permeable extended nip press (ENP) belt which is capable of being subjected to a tension of at least approximately 30 KN/m, wherein the permeable ENP belt includes at least one side including an open area of at least approximately 25% and a contact area of at least approximately 10%, preferably of at least approximately 25%.

The open area may be defined by through openings and the contact area is defined by a planar surface. The open area may be defined by through openings and the contact area is defined by a planar surface without openings, recesses, or grooves. The open area may be defined by through openings and grooves, and the contact area is defined by a planar surface without openings, recesses, or grooves. The permeable ENP belt may include a spiral link fabric. In this case, the open area may be between approximately 30% and approximately 85%, and the contact area may be between approximately 15% and approximately 70%. Preferably, the open area may be between approximately 45% and approximately 85%, and the contact area may be between approximately 15% and approximately 55%. Most preferably, the open area may be between approximately 50% and approximately 65%, and the contact area may be between approximately 35% and approximately 50%. The permeable ENP belt may include through openings arranged in a generally symmetrical pattern. The permeable ENP belt may include through openings arranged in generally parallel rows relative to a machine direction. The permeable ENP belt may include an endless circulating belt.

The permeable ENP belt may include through openings and the at least one side of the permeable ENP belt may include a plurality of grooves, each of the plurality of grooves intersects a different set of through hole. Each of the plurality of grooves may include a width, and each of the through openings may include a diameter, and wherein the diameter is greater than the width. Each of the plurality of grooves extend into the permeable ENP belt by an amount, which is less than a thickness of the permeable belt.

The tension may be greater than approximately 50 KN/m. The permeable ENP belt may include a flexible reinforced polyurethane member. The permeable ENP belt may include a flexible spiral link fabric. The permeable ENP belt may include a flexible polyurethane member having a plurality of reinforcing yarns embedded therein. The plurality of reinforcing yarns may include a plurality of machine direction yarns and a plurality of cross direction yarns. The permeable ENP belt may include a flexible polyurethane material and a plurality of reinforcing yarns embedded therein, said plurality of reinforcing yarns being woven in a spiral link manner.

The invention also provides for a method of subjecting a fibrous web to pressing in a paper machine, wherein the method includes applying pressure against a contact area of the fibrous web with a portion of a permeable belt, wherein the contact area is at least approximately 10%, preferably at least approximately 25% of an area of said portion and moving a fluid through an open area of said permeable belt and through the fibrous web, wherein said open area is at least approximately 25% of said portion, wherein, during the applying and the moving, said permeable belt has a tension of at least approximately 30 KN/m.

The contact area of the fibrous web may include areas, which are pressed more by the portion than non-contact areas of the fibrous web. The portion of the permeable belt may include a generally planar surface which includes no openings, recesses, or grooves and which is guided over a roll. The fluid may include air. The open area of the permeable belt may include through openings and grooves. The tension may be greater than approximately 50 KN/m.

The method may further include rotating a roll in a machine direction, wherein said permeable belt moves in concert with and is guided over or by said roll. The permeable belt may include a plurality of grooves and through openings, each of said plurality of grooves being arranged on a side of the permeable belt and intersecting with a different set of through openings. The applying and the moving may occur for a dwell time, which is sufficient to produce a fibrous web solids level in the range of between approximately 25% and approximately 55%. Preferably, the solids level may be greater than approximately 30%, and most preferably it is greater than approximately 40%. These solids levels may be obtained whether the permeable belt is used on a belt press or on a No Press/Low Press arrangement. The permeable belt may include a spiral link fabric.

The invention also provides for a method of pressing a fibrous web in a paper machine, wherein the method includes applying a first pressure against first portions of the fibrous web with a permeable belt and a second greater pressure against second portions of the fibrous web with a pressing portion of the permeable belt, wherein an area of the second portions is at least approximately 10% preferably of at least approximately 25% of an area of the first portions and moving air through open portions of said permeable belt, wherein an area of the open portions is at least approximately 25% of the pressing portion of the permeable belt which applies the first and second pressures, wherein, during the applying and the moving, said permeable belt has a tension of at least approximately 30 KN/m.

The tension may be greater than approximately 50 KN/m. The method may further include rotating a roll in a machine direction, said permeable belt moving in concert with said roll. The area of the open portions may be at least approximately 50%. The area of the open portions may be at least approximately 70%. The second greater pressure may be in the range of between approximately 30 KPa and approximately 150 KPa. The moving and the applying may occur substantially simultaneously.

The method may further include moving the air through the fibrous web for a dwell time, which is sufficient to produce a fibrous web solids in the range of between approximately 25% and approximately 55%.

The invention also provides for a method of drying a fibrous web in a belt press which includes a roll and a permeable belt including through openings, wherein an area of the through openings is at least approximately 25% of an area of a pressing portion of the permeable belt, and wherein the permeable belt is tensioned to at least approximately 30 KN/m, wherein the method includes guiding at least the pressing portion of the permeable belt over the roll, moving the fibrous web between the roll and the pressing portion of the permeable belt, subjecting at least approximately 10% preferably at least approximately 25% of the fibrous web to a pressure produced by portions of the permeable belt which are adjacent to the through openings, and moving a fluid through the through openings of the permeable belt and the fibrous web.

The invention also provides for a method of drying a fibrous web in a belt press which includes a roll and a permeable belt including through openings and grooves, wherein an area of the through openings is at least approximately 25% of an area of a pressing portion of the permeable belt, and wherein the permeable belt is tensioned to at least approximately 30 KN/m, wherein the method includes guiding at least the pressing portion of the permeable belt over the roll, moving the fibrous web between the roll and the pressing portion of the permeable belt, subjecting at least approximately 10% preferably at least approximately 25% of the fibrous web to a pressure produced by portions of the permeable belt which are adjacent to the through openings and the grooves, and moving a fluid through the through openings and the grooves of the permeable belt and the fibrous web.

According to another aspect of the invention, there is provided a more efficient dewatering process, preferably for the tissue manufacturing process, wherein the web achieves a dryness in the range of up to about 40% dryness. The process according to the invention is less expensive in machinery and in operational costs, and provides the same web quality as the TAD process. The bulk of the produced tissue web according to the invention is greater than approximately 10 $cm^3/g$, up to the range of between approximately 14 $cm^3/g$ and approximately 16 $cm^3/g$. The water holding capacity (measured by the basket method) of the produced tissue web according to the invention is greater than approximately 10 (g $H_2O$/g fiber), and up to the range of between approximately 14 (g $H_2O$/g fiber) and approximately 16 (g $H_2O$/g fiber). This also makes the whole drying process more efficient.

The invention also provides an efficient dewatering device, which could be utilized in combination with a TAD process.

The invention thus provides for a new dewatering process, for thin paper webs, with a basis weight less than approximately 42 $g/m^2$, preferably for tissue paper grades. The invention also provides for an apparatus, which utilizes this process and also provides for elements with a key function for this process.

A main aspect of the invention is a press system, which includes a package of at least one upper (or first), at least one lower (or second) fabric and a paper web disposed therebetween. A first surface of a pressure producing element is in contact with the at least one upper fabric. A second surface of a supporting structure is in contact with the at least one lower fabric and is permeable. A differential pressure field is provided between the first and the second surface, acting on the package of at least one upper and at least one lower fabric, and the paper web therebetween, in order to produce a mechanical pressure on the package and therefore on the paper web. This mechanical pressure produces a predetermined hydraulic pressure in the web, whereby the contained water is drained. The upper fabric has a bigger roughness and/or compressibility than the lower fabric. An airflow is caused in the direction from the at least one upper to the at least one lower fabric through the package of at least one upper and at least one lower fabric and the paper web therebetween.

Different possible modes and additional features are also provided. For example, the upper fabric may be permeable, and/or a so-called "structured fabric". By way of non-limiting examples, the upper fabric can be e.g., a TAD fabric, a membrane, a fabric, a printed membrane, or printed fabric. A lower fabric can include a permeable base fabric and a lattice grid attached thereto and which is made of polymer such as polyurethane. The lattice grid side of the fabric can be in contact with a suction roll while the opposite side contacts the paper web. The lattice grid can also be oriented at an angle relative to machine direction yarns and cross-direction yarns. The base fabric is permeable and the lattice grid can be a anti-rewet layer. The lattice can also be made of a composite material, such as an elastomeric material. The lattice grid can itself include machine direction yarns with the composite material being formed around these yarns. With a fabric of the above mentioned type it is possible to form or create a surface structure that is independent of the weave patterns.

The upper fabric may transport the web to and from the press system. The web can lie in the three-dimensional structure of the upper fabric, and therefore it is not flat but has also a three-dimensional structure, which produces a high bulky web. The lower fabric is also permeable. The design of the lower fabric is made to be capable of storing water. The lower fabric also has a smooth surface. The lower fabric is preferably a felt with a batt layer. The diameter of the batt fibers of the lower fabric are equal to or less than approximately 11 dtex, and can preferably be equal to or lower than approximately 4.2 dtex, or more preferably be equal to or less than approximately 3.3 dtex. The batt fibers can also be a blend of fibers. The lower fabric can also contain a vector layer which contains fibers from approximately 67 dtex, and can also contain even courser fibers such as, e.g., approximately 100 dtex, approximately 140 dtex, or even higher dtex numbers. This is important for the good absorption of water. The wetted surface of the batt layer of the lower fabric and/or of the lower fabric itself can be equal to or greater than approximately 35 $m^2/m^2$ felt area, and can preferably be equal to or greater than approximately 65 $m^2/m^2$ felt area, and can most preferably be equal to or greater than approximately 100 $m^2/m^2$ felt area. The specific surface of the lower fabric should be equal to or greater than approximately 0.04 $m^2/g$ felt weight, and can preferably be equal to or greater than approximately 0.065

$m^2$/g felt weight, and can most preferably be equal to or greater than approximately 0.075 $m^2$/g felt weight. This is important for the good absorption of water. The dynamic stiffness K*[N/mm] as a value for the compressibility is acceptable if less than or equal to 100,000 N/mm, preferable compressibility is less than or equal to 90,000 N/mm, and most preferably the compressibility is less than or equal to 70,000 N/mm. The compressibility (thickness change by force in mm/N) of the lower fabric is higher. This is also important in order to dewater the web efficiently to a high dryness level. A hard surface would not press the web between the prominent points of the structured surface of the upper fabric. On the other hand, the felt should not be pressed too deep into the three-dimensional structure to avoid deforming the fibrous sheet plastically and to avoid loosing bulk and therefore quality, e.g., water holding capacity.

The compressibility (thickness change by force in mm/N) of the upper fabric is lower than that of the lower fabric. The dynamic stiffness K*[N/mm] as a value for the compressibility of the upper fabric can be more than or equal to 3,000 N/mm and lower than the lower fabric. This is important in order to maintain the three-dimensional structure of the web, i.e., to ensure that the upper belt is a stiff structure.

The resilience of the lower fabric should be considered. The dynamic modulus for compressibility G*[N/$mm^2$] as a value for the resilience of the lower fabric is acceptable if more than or equal to 0.5 N/$mm^2$, preferable resilience is more than or equal to 2 N/$mm^2$, and most preferably the resilience is more than or equal to 4 N/$mm^2$. The density of the lower fabric should be equal to or higher than approximately 0.4 g/$cm^3$, and is preferably equal to or higher than approximately 0.5 g/$cm^3$, and is ideally equal to or higher than approximately 0.53 g/$cm^3$. This can be advantageous at web speeds of greater than approximately 1000 m/min. A reduced felt volume makes it easier to take the water away from the felt by the air flow, i.e., to get the water through the felt. Therefore the dewatering effect is smaller. The permeability of the lower fabric can be lower than approximately 80 cfm, preferably lower than approximately 40 cfm, and ideally equal to or lower than approximately 25 cfm. A reduced permeability makes it easier to take the water away from the felt by the air flow, i.e., to get the water through the felt. As a result, the re-wetting effect is smaller. A too high permeability, however, would lead to a too high air flow, less vacuum level for a given vacuum pump, and less dewatering of the felt because of the too open structure.

The second surface of the supporting structure can be flat and/or planar. In this regard, the second surface of the supporting structure can be formed by a flat suction box. The second surface of the supporting structure can preferably be curved. For example, the second surface of the supporting structure can be formed or run over a suction roll or cylinder whose diameter is, e.g., approximately g.t. 1 m or more for a machine 200" wide or 1.75 m wide. The suction device or cylinder may include at least one suction zone. It may also include two or more suction zones. The suction cylinder may also include at least one suction box with at least one suction arc. At least one mechanical pressure zone can be produced by at least one pressure field (i.e., by the tension of a belt) or through the first surface by, e.g., a press element. The first surface can be an impermeable belt, but with an open surface toward the first fabric, e.g., a grooved or a blind drilled and grooved open surface, so that air can flow from outside into the suction arc. The first surface can be a permeable belt. The belt may have an open area of at least approximately 25%, preferably greater than approximately 35%, most preferably greater than approximately 50%. The belt may have a contact area of at least approximately 10%, at least approximately 25%, and preferably up to approximately 50% in order to have a good pressing contact.

In addition, the pressure field can be produced by a pressure element, such as a shoe press or a roll press. This has the following advantage: If a very high bulky web is not required, this option can be used to increase dryness and therefore production to a desired value, by adjusting carefully the mechanical pressure load. Due to the softer second fabric the web is also pressed at least partly between the prominent points (valleys) of the three-dimensional structure. The additional pressure field can be arranged preferably before (no re-wetting), after or between the suction area. The upper permeable belt is designed to resist a high tension of more than approximately 30 KN/m, and preferably approximately 60 KN/m, or higher e.g., approximately 80 KN/M. By utilizing this tension, a pressure is produced of greater than approximately 0.5 bars, and preferably approximately 1 bar, or higher, may be e.g., approximately 1.5 bar. The pressure "p" depends on the tension "S" and the radius "R" of the suction roll according to the well known equation, p=S/R. A bigger roll requires a higher tension to reach a given pressure target. The upper belt can also be a stainless steel and/or a metal band and/or a polymeric belt.

The permeable upper belt can be made of a reinforced plastic or synthetic material. It can also be a spiral linked fabric. Preferably, the belt can be driven to avoid shear forces between the first and second fabrics and the web. The suction roll can also be driven. Both of these can also be driven independently.

The first surface can be a permeable belt supported by a perforated shoe for the pressure load.

The air flow can be caused by a non-mechanical pressure field as follows: with an underpressure in a suction box of the suction roll or with a flat suction box, or with an overpressure above the first surface of the pressure producing element, e.g., by a hood, supplied with air, e.g., hot air of between approximately 50 degrees C. and approximately 180 degrees C., and preferably between approximately 120 degrees C. and approximately 150 degrees C., or also preferably steam. Such a higher temperature is especially important and preferred if the pulp temperature out of the headbox is less than about 35 degrees C. This is the case for manufacturing processes without or with less stock refining. Of course, all or some of the above-noted features can be combined.

The pressure in the hood can be less than approximately 0.2 bar, preferably less than approximately 0.1, most preferably less than approximately 0.05 bar. The supplied air flow to the hood can be less or preferable equal to the flow rate sucked out of the suction roll by vacuum pumps. By way of non-limiting example, the supplied air flow per meter width to the hood can be approximately 140 $m^3$/min can be at atmospheric pressure. The temperature of the air flow can be at approximately 115 degrees C. The flow rate sucked out of the suction roll with a vacuum pump can be approximately 500 $m^3$/min with a vacuum level of approximately 0.63 bar at 25 degrees C.

The suction roll can be wrapped partly by the package of fabrics and the pressure producing element, e.g., the belt, whereby the second fabric has the biggest wrapping arc "a1" and leaves the arc zone lastly. The web together with the first fabric leaves secondly, and the pressure producing element leaves firstly. The arc of the pressure producing element is bigger than arc of the suction box. This is important, because at low dryness, the mechanical dewatering is more efficient than dewatering by airflow. The smaller suction arc "a2" should be big enough to ensure a sufficient dwell time for the air flow to reach a maximum dryness. The dwell time "T"

should be greater than approximately 40 ms, and preferably is greater than approximately 50 ms. For a roll diameter of approximately 1.2 m and a machine speed of approximately 1200 m/min, the arc "a2" should be greater than approximately 76 degrees, and preferably greater than approximately 95 degrees. The formula is a2=[dwell time*speed*360/circumference of the roll].

The second fabric can be heated e.g., by steam or process water added to the flooded nip shower to improve the dewatering behavior. With a higher temperature, it is easier to get the water through the felt. The belt could also be heated by a heater or by the hood or steambox. The TAD-fabric can be heated especially in the case when the former of the tissue machine is a double wire former. This is because, if it is a crescent former, the TAD fabric will wrap the forming roll and will therefore be heated by the stock, which is injected by the headbox.

There are a number of advantages of this process describe herein. In the prior art TAD process, ten vacuum pumps are needed to dry the web to approximately 25% dryness. On the other hand, with the advanced dewatering system of the invention, only six vacuum pumps dry the web to approximately 35%. Also, with the prior art TAD process, the web must be dried up with a TAD drum and air system to a high dryness level of between about 60% and about 75%, otherwise a poor moisture cross profile would be created. This way lots of energy is wasted and the Yankee/Hood capacity is used only marginally. The system of the instant invention makes it possible to dry the web in a first step up to a certain dryness level of between approximately 30% to approximately 40%, with a good moisture cross profile. In a second stage, the dryness can be increased to an end dryness of more than approximately 90% using a conventional Yankee dryer combined the inventive system. One way to produce this dryness level, can include more efficient impingement drying via the hood on the Yankee.

The invention also provides for a belt press for a paper machine, wherein the belt press includes a roll including an exterior surface. A permeable belt includes a first side and is guided over a portion of said exterior surface of the roll. The permeable belt has a tension of at least approximately 30 KN/m. The first side has an open area of at least approximately 25% and a contact area of at least approximately 10%, preferably of at least approximately 25%. A web travels between the permeable belt and the exterior surface of the roll.

The first side may face the exterior surface and the permeable belt may exert a pressing force on the roll. The permeable belt may include through openings. The permeable belt may include through openings arranged in a generally regular symmetrical pattern. The permeable belt may include generally parallel rows of through openings, whereby the rows are oriented along a machine direction. The permeable belt may exert a pressing force on the roll in the range of between approximately 30 KPa to approximately 150 KPa. The permeable belt may include through openings and a plurality of grooves, each groove intersecting a different set of through openings. The first side may face the exterior surface and wherein said permeable belt exerts a pressing force on said roll. The plurality of grooves may be arranged on the first side. Each of said plurality of grooves may include a width, and wherein each of the through openings includes a diameter, and wherein said diameter is greater than said width. The tension of the belt may be greater than approximately 50 KN/m. The tension of the belt may be greater than approximately 60 KN/m. The tension of the belt may be greater than approximately 80 KN/m. The roll may comprise a vacuum roll. The roll may include a vacuum roll having an interior circumferential portion. The vacuum roll may include at least one vacuum zone arranged within said interior circumferential portion. The roll may include a vacuum roll having a suction zone. The suction zone may include a circumferential length of between approximately 200 mm and approximately 2,500 mm. The circumferential length may be in the range of between approximately 800 mm and approximately 1,800 mm. The circumferential length may be in the range of between approximately 1,200 mm and approximately 1,600 mm.

The invention also provides for a fibrous material drying arrangement, which includes an endlessly circulating permeable extended nip press (ENP) belt guided over a roll. The ENP belt is subjected to a tension of at least approximately 30 KN/m. The ENP belt includes a side having an open area of at least approximately 25% and a contact area of at least approximately 10%, preferably of at least 25%. A web travels between the ENP belt and the roll.

The invention also provides for a permeable extended nip press (ENP) belt which is capable of being subjected to a tension of at least approximately 30 KN/m, wherein the permeable ENP belt includes at least one side including an open area of at least approximately 25% and a contact area of at least approximately 10%, preferably of at least approximately 25%.

The open area may be defined by through openings and the contact area may be defined by a planar surface. The open area may be defined by through openings and the contact area may be defined by a planar surface without openings, recesses, or grooves. The open area may be defined by through openings and grooves, and the contact area may be defined by a planar surface without openings, recesses, or grooves. The ENP belt may include a spiral link fabric. The permeable ENP belt may include through openings arranged in a generally symmetrical pattern. The permeable ENP belt may include through openings arranged in generally parallel rows relative to a machine direction. The permeable ENP belt may include an endless circulating belt. The permeable ENP belt may include through openings and the at least one side of the permeable ENP belt may include a plurality of grooves, each of said plurality of grooves intersecting a different set of through hole. Each of said plurality of grooves may include a width, and each of the through openings may include a diameter, and the diameter may be greater than the width. Each of the plurality of grooves may extend into the permeable ENP belt by an amount that is less than a thickness of the permeable belt. The tension may be greater than approximately 50 KN/m. The permeable ENP belt may include a flexible spiral link fabric. The permeable ENP belt may include at least one spiral link fabric. The at least one spiral link fabric may include a synthetic material. The at least one spiral link fabric may include stainless steel. The permeable ENP belt may include a permeable fabric that is reinforced by at least one spiral link belt.

The invention also provides for a method of drying a paper web in a press arrangement, wherein the method includes moving the paper web, disposed between at least one first fabric and at least one second fabric, between a support surface and a pressure producing element and moving a fluid through the paper web, the at least one first and second fabrics, and the support surface.

The invention also provides for a belt press for a paper machine, wherein the belt press includes a vacuum roll including an exterior surface and at least one suction zone. A permeable belt includes a first side and being guided over a portion of said exterior surface of said vacuum roll. The permeable belt has a tension of at least approximately 30 KN/m. The first side has an open area of at least approximately 25% and a contact area of at least approximately 10%, preferably of at least approximately 25%. A web travels between the permeable belt and the exterior surface of the roll.

The at least one suction zone may include a circumferential length of between approximately 200 mm and approximately 2,500 mm. The circumferential length may define an arc of between approximately 80 degrees and approximately 180 degrees. The circumferential length may define an arc of between approximately 80 degrees and approximately 130 degrees. The at least one suction zone may be adapted to apply vacuum for a dwell time which is equal to or greater than approximately 40 ms. The dwell time may be equal to or greater than approximately 50 ms. The permeable belt may exert a pressing force on said vacuum roll for a first dwell time which is equal to or greater than approximately 40 ms. The at least one suction zone may be adapted to apply vacuum for a second dwell time which is equal to or greater than approximately 40 ms. The second dwell time may be equal to or greater than approximately 50 ms. The first dwell time may be equal to or greater than approximately 50 ms. The permeable belt may include at least one spiral link fabric. The at least one spiral link fabric may include a synthetic material. The at least one spiral link fabric may include stainless steel. The at least one spiral link fabric may include a tension which is between approximately 30 KN/m and approximately 80 KN/m. The tension may be between approximately 35 KN/m and approximately 50 KN/m.

The invention also provides for a method of pressing and drying a paper web, wherein the method includes pressing, with a pressure producing element, the paper web between at least one first fabric and at least one second fabric and simultaneously moving a fluid through the paper web and the at least one first and second fabrics.

The pressing may occur for a dwell time which is equal to or greater than approximately 40 ms. The dwell time may be equal to or greater than approximately 50 ms. The simultaneously moving may occur for a dwell time which is equal to or greater than approximately 40 ms. The dwell time may be equal to or greater than approximately 50 ms. The pressure producing element may include a device which applied a vacuum. The vacuum may be greater than approximately 0.5 bar. The vacuum may be greater than approximately 1 bar. The vacuum may be greater than approximately 1.5 bar.

With the system according to the invention, there is no need for through air drying. A paper having the same quality as produced on a TAD machine is generated with the inventive system utilizing the whole capability of impingement drying which is more efficient in drying the sheet from about 35% to more than about 90% solids.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
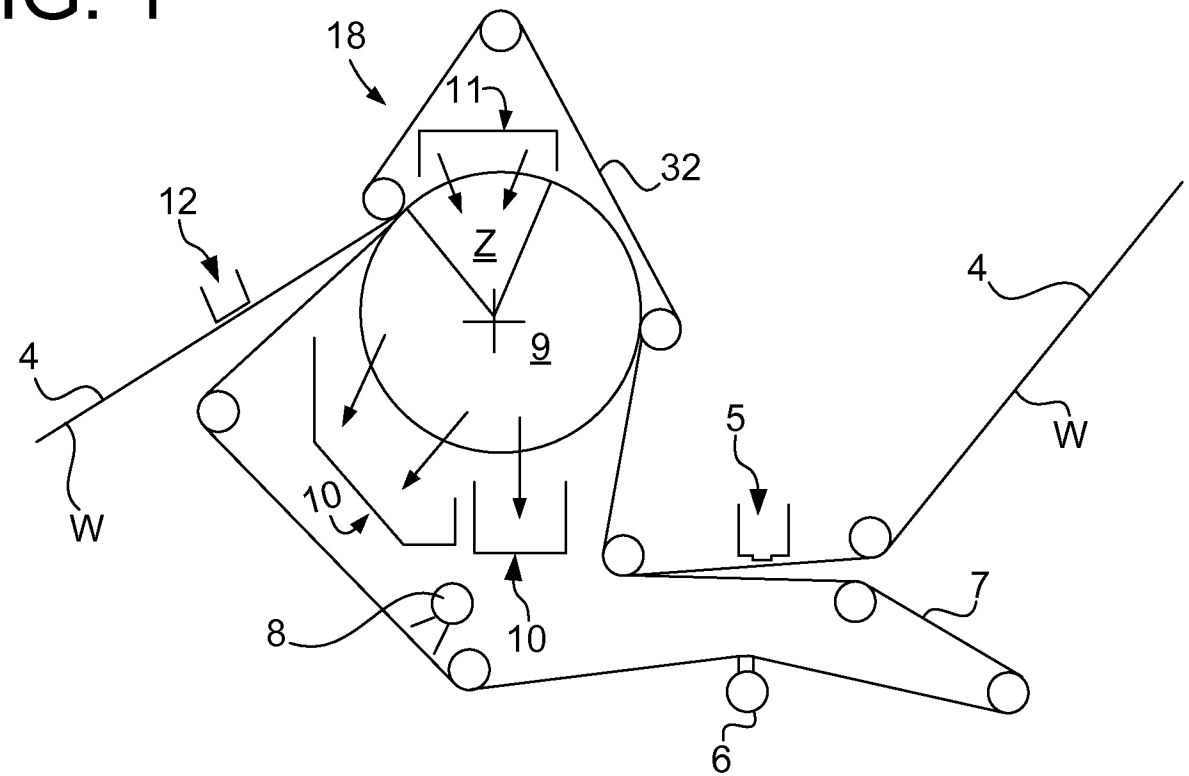
FIGS. 1, 2, 2*a* and 3-8 show cross-sectional schematic diagrams of various embodiments of advanced dewatering systems according to the present invention.

Referring now to the drawings, FIG. 1 shows a diagram of the Advanced Dewatering System (ADS) that utilizes a main pressure field in the form of a belt press 18. A formed web W is carried by a structured fabric 4 to a vacuum box 5 that is required to achieve a solids level of between approximately 15% and approximately 25% on a nominal 20 gsm web running at between approximately −0.2 and approximately −0.8 bar vacuum, and can preferred operate at a level of between approximately −0.4 and approximately −0.6 bar. A vacuum roll 9 is operated at a vacuum level of between approximately −0.2 and approximately −0.8 bar, preferably it is operated at a level of approximately −0.4 bar or higher. Belt press 18 includes a single fabric run 32 capable of applying pressure to the non-sheet contacting side of the structured fabric 4 that carries the web W around suction roll 9. Fabric 32 is a continuous or endless circulating belt that guided around a plurality of guide rolls and is characterized by being permeable. An optional hot air hood 11 is arranged within the belt 32 and is positioned over vacuum roll 9 in order to improve dewatering. Vacuum roll 9 includes at least one vacuum zone Z and has circumferential length of between approximately 200 mm and approximately 2500 mm, preferably between approximately 800 mm and approximately 1800 mm, and more preferably between approximately 1200 mm and approximately 1600 mm. The thickness of the vacuum roll shell can preferably be in the range of between approximately 25 mm and approximately 75 mm. The mean airflow through the web 112 in the area of suction zone Z can be approximately 150 $m^3$/min per meter machine width. The solid level leaving the suction roll 9 is between approximately 25% and approximately 55% depending on the installed options, and is preferably greater than approximately 30%, is more preferably greater than approximately 35%, and is even more preferably greater than approximately 40%. An optional pick up vacuum box 12 can be used to make sure that the sheet or web W follows structured fabric 4 and separates from a dewatering fabric 7. It should be noted that the direction of air flow in a first pressure field (i.e., vacuum box 5) and the main pressure field (i.e., formed by vacuum roll 9) are opposite to each other. The system also utilizes one or more shower units 8 and one or more Uhle boxes 6.

There is a significant increase in dryness with belt press 18. Belt 32 should be capable of sustaining an increase in belt tension of up to approximately 80 KN/m without being destroyed and without destroying web quality. There is roughly about a 2% more dryness in the web W for each tension increase of 20 KN/m. A synthetic belt may not achieve a desired file force of less than approximately 45 KN/m and the belt may stretch too much during running on the machine. For this reason, belt 32 can, for example, be a pin seamable belt, a spiral link fabric, and possibly even a stainless steel metal belt.

Figure 30A:
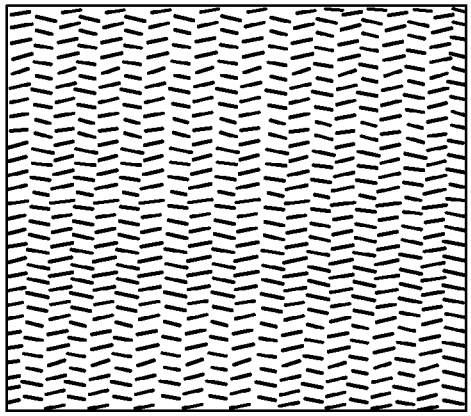
FIG. 30*a* illustrates an area of an Ashworth metal belt, which can be used in the invention. The portions of the belt, which are shown in black, represent the contact area whereas the portions of the belt shown in white represent the non-contact area.
Figure 30B:
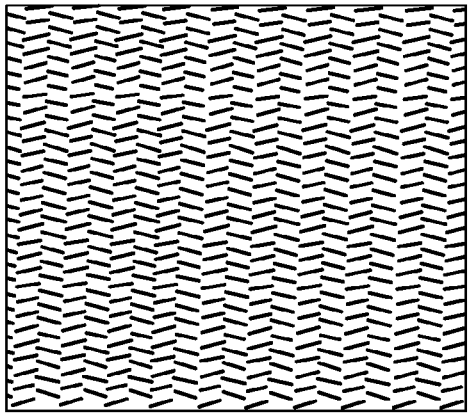
FIG. 30*b* illustrates an area of a Cambridge metal belt, which can be used in the invention. The portions of the belt which are shown in black represent the contact area whereas the portions of the belt shown in white represent the non-contact area.
Figure 30C:
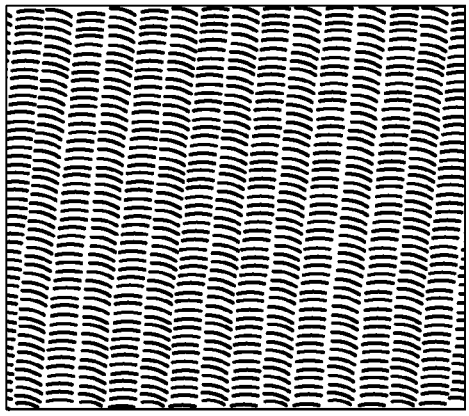
FIG. 30*c* illustrates an area of a Voith Fabrics link fabric, which can be used in the invention. The portions of the belt, which are shown in black, represent the contact area whereas the portions of the belt shown in white represent the non-contact area.

Permeable belt 32 can have yarns interlinked by entwining generally spiral woven yarns with cross yarns in order to form a link fabric. Non-limiting examples of this belt can include a Ashworth Metal Belt, a Cambridge Metal belt and a Voith Fabrics Link Fabric and are shown in FIGS. 30*a-c*. The spiral link fabric described in this specification can also be made of a polymeric material and/or is preferably tensioned in the range of between approximately 30 KN/m and 80 KN/m, and preferably between approximately 35 KN/m and approximately 50 KN/m. This provides improved runnability of the belt, which is not able to withstand high tensions, and is balanced with sufficient dewatering of the paper web. FIG. 30*a* illustrates an area of the Ashworth metal belt, which is acceptable for use in the invention. The portions of the belt, which are shown in black, represent the contact area whereas the portions of the belt shown in white represent the non-contact area. The Ashworth belt is a metal link belt, which is tensioned at approximately 60 KN/m. The open area may be between approximately 75% and approximately 85%. The contact area may be between approximately 15% and approximately 25%. FIG. 30*b* illustrates an area of a Cambridge metal belt, which is preferred for use in the invention. Again, the portions of the belt, which are shown in black, represent the contact area whereas the portions of the belt shown in white represent the non-contact area. The Cambridge belt is a metal link belt, which is tensioned at approximately 50 KN/m. The open area may be between approximately 68% and approximately 76%. The contact area may be between approximately 24% and approximately 32%. Finally, FIG. 30*c* illustrates an area of a Voith Fabrics link fabric, which is most preferably used in the invention. The portions of the belt, which are shown in black, represent the contact area whereas the portions of the belt shown in white represent the non-contact area. The Voith Fabrics belt may be a polymer link fabric, which is tensioned at approximately 40 KN/m. The open area may be between approximately 51% and approximately 62%. The contact area may be between approximately 38% and approximately 49%.

Dewatering fabric 7 can be of a very thin construction, which reduces the amount of water being carried by an order of magnitude to improve dewatering efficiency and reduce/eliminate the rewetting phenomena seen with prior art structures. However, there does not appear to any gain in dryness in a belt press, which presses over a thin anti-rewet membrane. Thicker and softer belt structures benefit more from the belt press. A needle batt structure felt may be a better option for belt 7. By heating dewatering fabric 7 to as much as approximately 50 degrees C., it is possible to achieve as much as approximately 1.5% more dryness. For all dwell times above approximately 50 ms, the dwell time does not appear to affect dryness, and the higher the vacuum level in the roll 9, the higher the dryness of web W.

As regards the fiber suspension used for web W, there can also be a significant gain in dryness by using a high consistency refiner versus a low consistency refiner. A lower SR degree, less fines, more porosity results in better a dewatering capability. There can also be advantageous in using the right furnish. By running comparison trials between high consistency refining (approximately 30% consistency) and low consistency refining (approximately 4.5% consistency), the inventors were able to achieve the same tensile strength needed for tissue towel paper, but with less refining degree. The same tensile strength was achieved by refining 100% softwood to 17 SR instead of 21 SR, i.e., it resulted in approximately 4 degrees less Schopper Riegler. By comparing high consistency refining to low consistency refining at the same refining degree, i.e., at 17 SR, the inventors were able to achieve 30% more tensile strength with the high consistency refining. The high consistency refining was accomplished with a thickener, which can be a wire press or a screw press, followed by a disc dispenser with a refining filling. This is possible for tissue papers because the required tensile strength is low. To reach the tensile target for towel paper, the inventors used two passes through the disc dispenser. The big advantage of the above-noted process is to reduce refining, thus resulting in less fines, lower WRV (water retention value), more porosity and better dewatering capability for the ADS concept. With better dewatering capacity it is possible to increase machine speed, and in addition, the lower refining degree increases paper quality.

Embodiments of the main pressure field include a suction roll or a suction box. Non-limiting examples of such devices are described herein. The mean airflow speed through the sheet or web in the main pressure field is preferably approximately 6 m/s.

Non-limiting examples or aspects of dewatering fabric 7 will now be described. One preferred structure is a traditional needle punched press fabric, with multiple layers of batt fiber, wherein the batt fiber ranges from between approximately 0.5 dtex to approximately 22 dtex. Belt 7 can include a combination of different dtex fibers. It can also preferably contain an adhesive to supplement fiber to fiber bonding, for example, low melt fibers or particles, and/or resin treatments. Belt 7 may be a thin structure, which is preferably less than approximately 1.50 mm thick, or more preferably less than approximately 1.25 mm, and most preferably less than approximately 1.0 mm. Belt 7 can include weft yarns which can be multifilament yarns usually twisted/plied. The weft yarns can also be solid mono strands usually less than approximately 0.30 mm diameter, preferably approximately 0.20 mm in diameter, or as low as approximately 0.10 mm in diameter. The weft yarns can be a single strand, twisted or cabled, or joined side by side, or a flat shape. Belt 7 can also utilize warp yarns which are monofilament and which have a diameter of between approximately 0.30 mm and approximately 0.10 mm. They may be twisted or single filaments, which can preferably be approximately 0.20 mm in diameter. Belt 7 can be needled punched with straight through drainage channels, and may preferably utilize a generally uniform needling. Belt 7 can also include an optional thin hydrophobic layer applied to one of its surfaces with, e.g., an air perm of between approximately 5 to approximately 100 cfm, and preferably approximately 19 cfm or higher, most preferably approximately 35 cfm or higher. The mean pore diameter can be in the range of between approximately 5 to approximately 75 microns, preferably approximately 25 microns or higher, more preferably approximately 35 microns or higher. The belt 7 can be made of various synthetic polymeric materials, or even wool, etc., and can preferably be made of polyamides such as, e.g., Nylon 6.

An alternative structure for belt 7 can be a woven base cloth laminated to an anti-rewet layer. The base cloth is woven endless structure using between approximately 0.10 mm and approximately 0.30 mm, and preferably approximately 0.20 mm diameter monofilament warp yarns (cross machine direction yarns on the paper machine) and a combination multifilament yarns usually twisted/plied. The yarns can also be solid mono strands usually less than approximately 0.30 mm diameter, preferably approximately 0.20 mm in diameter, or as low as approximately 0.10 mm in diameter. The weft yarns can be a single strand, twisted or cabled, joined side by side, or a flat shape weft (machine direction yarns on the paper machine). The base fabric can be laminated to an anti-rewet layer, which preferably is a thin elastomeric cast permeable membrane. The permeable membrane can be approximately 1.05 mm thick, and preferably less than approximately 1.05 mm. The purpose of the thin elastomeric cast membrane is to prevent sheet rewet by providing a buffer layer of air to delay water from traveling back into the sheet, since the air needs to be moved before the water can reach the sheet. The lamination process can be accomplished by either melting the elastomeric membrane into the woven base cloth, or by needling two or less thin layers of batt fiber on the face side with two or less thin layers of batt fiber on the back side to secure the two layers together. An optional thin hydrophobic layer can be applied to the surface. This optional layer can have an air perm of approximately 130 cfm or lower, preferably approximately 100 cfm or lower, and most preferably approximately 80 cfm or lower. Belt 7 may have a mean pore diameter of approximately 140 microns or lower, more preferably approximately 100 microns or lower, and most preferably approximately 60 microns or lower.

Another alternative structure for belt 7 utilizes an anti-rewet membrane which includes a thin woven multifilament textile cloth laminated to a thin perforated hydrophobic film, with an air perm of 35 cfm or less, preferably 25 cfm or less, with a mean pore size of 15 microns.

The belt may also preferably utilize vertical flow channels. These can be created by printing polymeric materials on to the fabric. They can also be created by a special weave pattern which uses low melt yarns that are subsequently thermoformed to create channels and air blocks to prevent leakage. Such structures can be needle punched to provide surface enhancements and wear resistance.

The fabrics used for belt 7 can also be seamed/joined on the machine socked on when the fabrics are already joined. The on-machine seamed/joined method does not interfere with the dewatering process.

The surface of fabrics 7 described in this application can be modified to alter surface energy. They can also have blocked in-plane flow properties in order to force exclusive z-direction flow.

FIG. 1 can also have the following configuration. A belt press 18 fits over vacuum roll 9. A permeable fabric 32 run is capable of applying pressure to the non-sheet contacting side of structured fabric 4 that carries web W around the suction roll 9. Single fabric 32 is characterized by being permeable. An optional hot air hood 11 is fit over vacuum roll 9 inside belt press 18 to improve dewatering. Permeable fabric 32 used in belt press 18 is a specially designed Extended Nip Press (ENP) belt, for example a flexible reinforced polyurethane belt, which provides a low level of pressing in the range of between approximately 30 to approximately 150 KPa, and preferably greater than approximately 100 KPa. This means, for example, for a suction roll 9 with a diameter of approximately 1.2 meters, the fabric tension of belt 32 can be greater than approximately 30 KN/m, and preferably greater than approximately 50 KN/m. The pressing length can be shorter, equal to, or longer the circumferential length of suction zone Z of roll 9. ENP belt 32 can have grooves or it can have a monoplaner surface. Fabric 32 can have a drilled hole pattern, so that sheet W is impacted with both pressing and vacuum with air flow simultaneously. The combination has been shown to increase sheet solids by as much as approximately 15%. The specially designed ENP belt is only an example of a particular fabric that can be used for this process and is by no means the only type of structure that can be used. One essential feature of permeable fabric 32 for belt press 18 is a fabric that can run at abnormally high running tension (i.e., approximately 50 KN/m or higher) with relatively high surface contact area (i.e., approximately 10% or 25% or greater) and a high open area (i.e., approximately 25% or greater).

An example of another option for belt 32 is a thin spiral link fabric. The spiral link fabric can be used alone as fabric 32 or, for example, it can be arranged inside the ENP belt. As described above, fabric 32 rides over structured fabric 4 applying pressure thereon. The pressure is then transmitted through structured fabric 4, which is carrying web W. The high basis weight pillow areas of web W are protected from this pressure as they are within the body of structured fabric 4. Therefore, this pressing process does not impact negatively on web quality, but increases the dewatering rate of the suction roll. Belt 32 used in the belt press shown in FIG. 1 can also be of the type used in the belt presses described with regard to FIGS. 9-28 herein.

Figure 2:
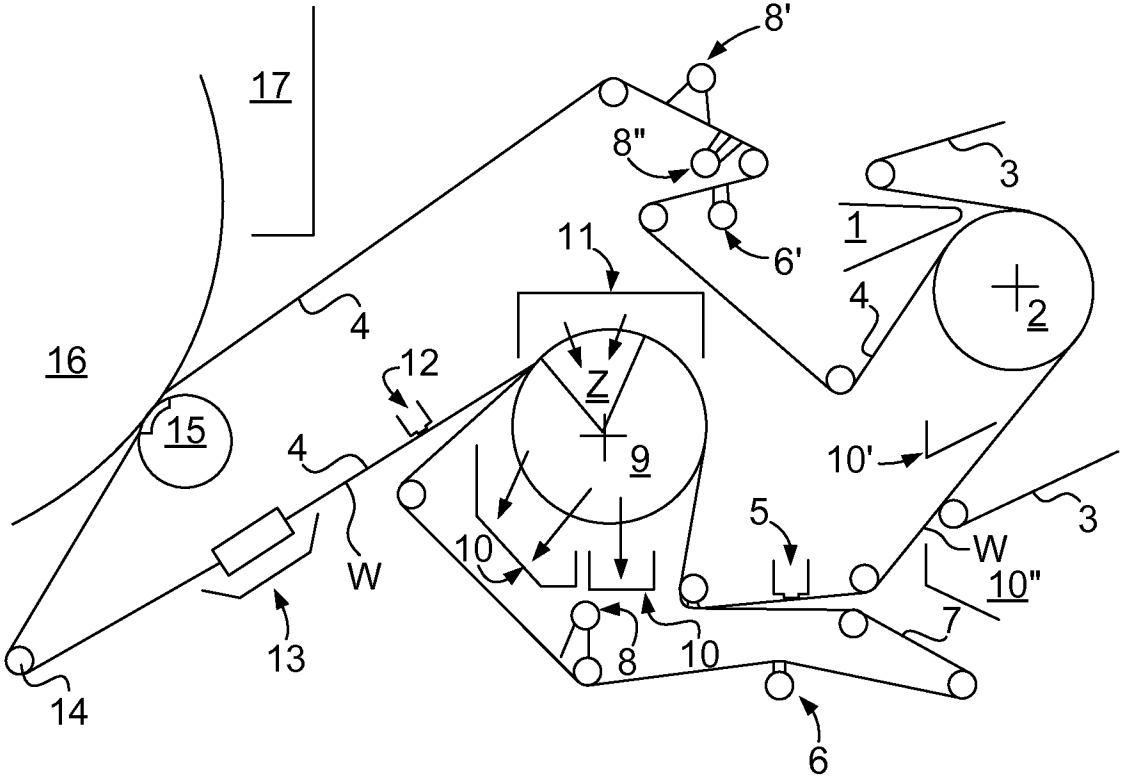

The invention also provides that suction roll 9 can be arranged between the former and a Yankee roll. The sheet or web W is carried around suction roll 9. The roll has a separate fabric 32, which runs with a specially designed dewatering fabric 7. It could also have a second fabric run below dewatering fabric 7 to further disperse the air. The web W comes in contact with dewatering fabric 7 and is dewatering sufficiently to promote transfer to a hot Yankee/Hood for further drying and subsequent creping. FIG. 2 shows several of the possible add-on options to enhance the process. However, it is by no means is a complete list, and is shown for demonstrations purposes only. An aspect of the invention provides for forming a light weight tissue web on a structured fabric 4 (which can also be a an imprinting or TAD fabric) and providing such a web W with sufficient solids to affect transfer to the Yankee Dryer for subsequent drying, creping, and reeling up.

Referring back to FIG. 2, a vacuum box 5 is utilized to achieve a solids level of between approximately 15% and approximately 25% on a nominal 20 gsm web W running at between approximately −0.2 bar to approximately −0.8 bar vacuum, and can preferably operate at a level of between approximately −0.4 bar and approximately −0.6 bar. Vacuum roll 9 is operated at a vacuum level of between approximately −0.2 bar to approximately −0.8 bar, and is preferably operated at a level of between approximately −0.4 bar or higher. An optional hot air hood 11 is fit over vacuum roll 9 to improve dewatering. The circumferential length of vacuum zone Z inside vacuum roll 9 can be from between approximately 200 mm to approximately 2500 mm, is preferably between approximately 800 mm and approximately 1800 mm, and is more preferably between approximately 1200 mm and approximately 1600 mm. By way on non-limiting example, the thickness of the vacuum roll shell can preferably be in the range of between approximately 25 mm and approximately 75 mm. The mean airflow through web 112 in the area of the suction zone Z can be approximately 150 $m^3$/min per meter machine width. The solids leaving suction roll 9 can be between approximately 25% to approximately 55% depending on the installed options, and is preferably greater than approximately 30%, even more preferably greater than approximately 35%, and most preferably greater than approximately 40%.

Figure 2A:
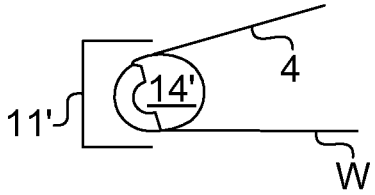

An optional vacuum box 12 can be used to ensure that the sheet or web W follows structured fabric 4 after vacuum roll 9. An optional vacuum box with hot air supply hood 13 could also be used to increase sheet solids after vacuum roll 9 and before a Yankee cylinder 16. A wire turning roll 14 can also be utilized. As can be seen in FIG. 2*a*, roll 14 can be a suction turning roll with hot air supply hood 11'. By way of a non-limiting example, standard pressure roll 15 can also be a shoe press with shoe width of approximately 80 mm or higher, and is preferably approximately 120 mm or higher, and it may utilize a maximum peak pressure which is preferably less than approximately 2.5 MPa. To create an even longer nip, in order to facilitate web transfer to the Yankee roll 16 from belt 4, web W with structured fabric 4 is brought into contact with a surface of Yankee roll 16 prior to the press nip formed by roll 15 and Yankee roll 16. Alternatively, structured fabric 4 can be in contact with the surface of Yankee roll 16 for some distance following the press nip formed by roll 15 and Yankee roll 16. According to another alternative possibility, both or the combination of these features can be utilized.

As can be seen in FIG. 2, the arrangement utilizes a headbox 1, a forming roll 2 which can be solid or a suction forming roll, a forming fabric 3 which can be a DSP belt, a plurality of Uhle boxes 6,6', a plurality of showers 8, 8', and 8", a plurality of savealls 10,10', and 10", and a hood 17.

Figure 3:
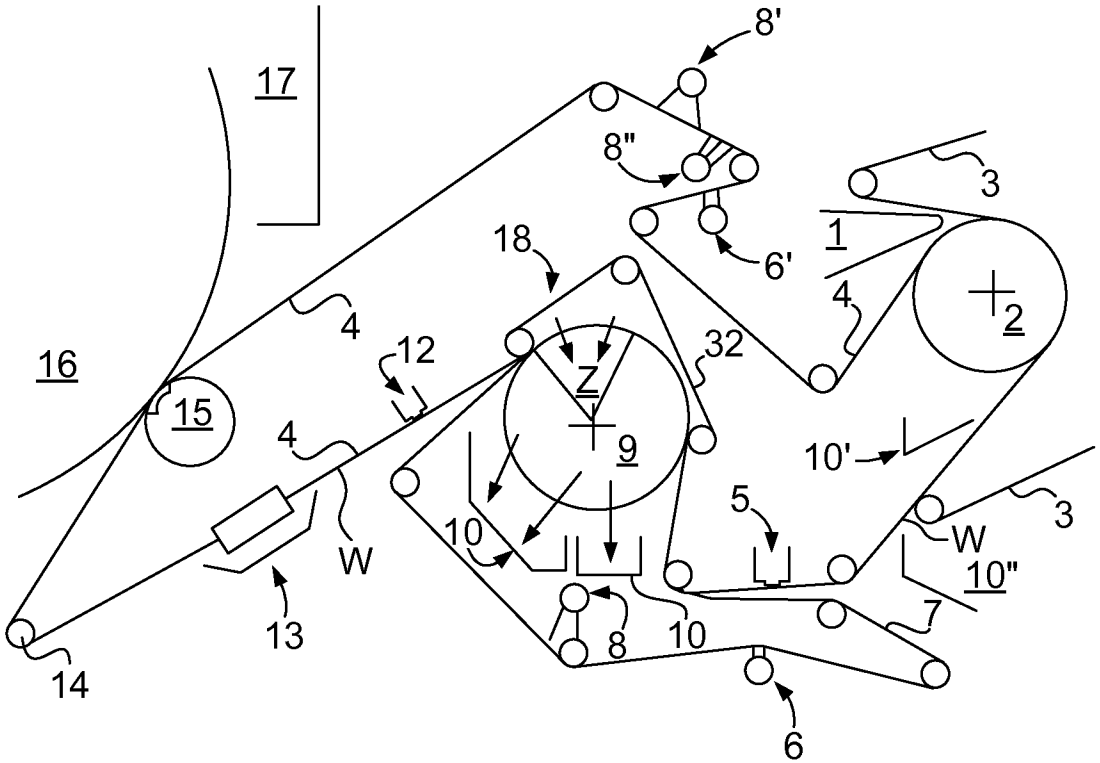

FIG. 3 shows yet another embodiment of the Advanced Dewatering System. This embodiment is generally the same as the embodiment shown in FIG. 2 and with the addition of a belt press 18 arranged on top of the suction roll 9 instead of a hot hood. Belt press 18 includes a single fabric run 32. Fabric 32 is permeable beat that is capable of applying pressure to the non-sheet contacting side of structured fabric 4 that carries web W around suction roll 9. Permeable fabric 32 can be of any type described in the instant application as forming a belt press with a suction roll or with suction box such as belt 32, described with regard to e.g., FIGS. 1 and 4-8.

Figure 4:
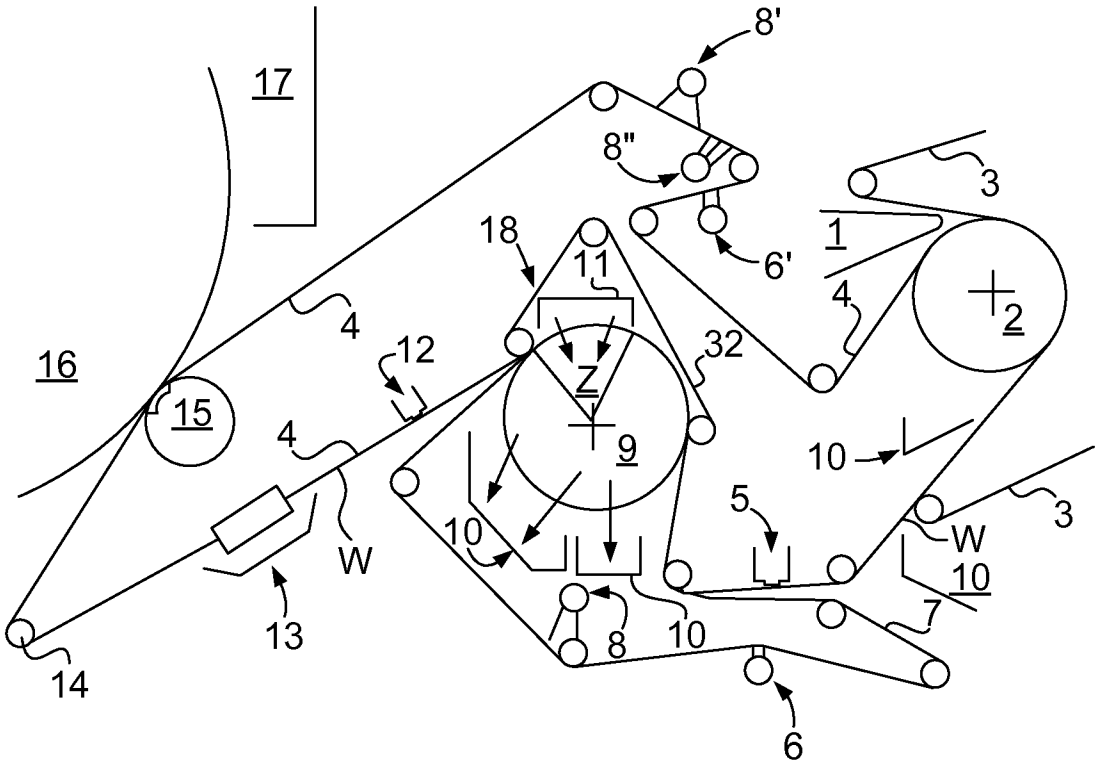

FIG. 4 shows yet another embodiment of an Advanced Dewatering System. The system is similar to that of FIGS. 2 and 3 and uses both a belt press 18 described with regard to FIG. 3 and hood 11 of the type described with regard to FIG. 2. Hood 11 is a hot air supply hood and is placed over permeable fabric 4. Fabric 4 can be, e.g., an ENP belt or a spiral link fabric of the type described in this application. As with many of the previous embodiments, the belt 4 rides over top of structured fabric 4 that carries web W. As was the case with previous embodiments, web W is arranged between structured belt 4 and dewatering belt 7 in such a way that web B is in contact with dewatering fabric 7 as it wraps around suction roll 9. In this way, the dewatering of web W is facilitated.

Figure 5:
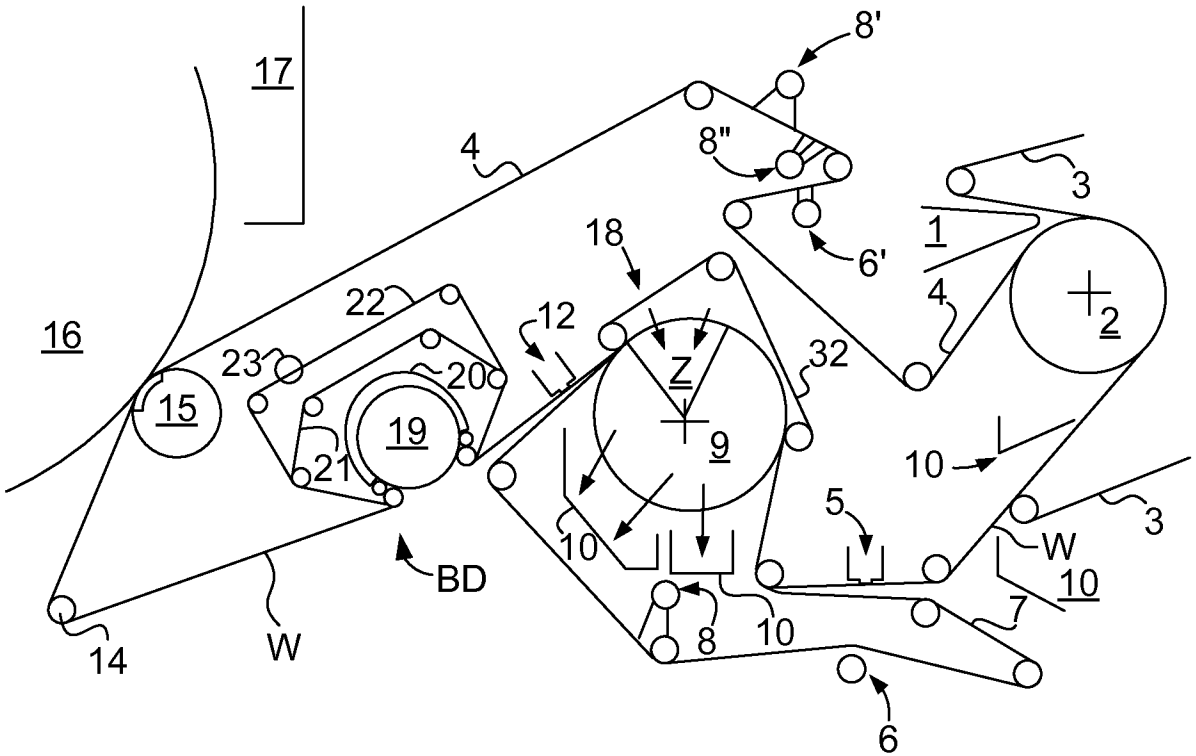

FIG. 5 shows yet another embodiment of the Advanced Dewatering System. This embodiment is similar to that of FIG. 3 except that between suction roll 9 and Yankee roll 16 (and instead of the suction box and hood 13) there is arranged a boost dryer BD for additional web drying prior to transfer of web W to Yankee roll 16 and the pressing point between rolls 15 and 16. The value of boost dryer BD is that it provides additional drying to the system/process so that the machine will have an increased production capacity. Web W is carried into boost dryer BD while on structured fabric 4. The sheet or web W is then brought in contact with the hot surface of boost dryer roll 19 and is carried around the hot roll exiting significantly dryer than it was coming into boost dryer BD. A woven fabric 22 rides on top of structured fabric 4 around the boost dryer roll 19. On top of this woven fabric 22 is a specially designed metal fabric 21, which is in contact with both woven fabric 22 and a cooling jacket 20 that is applying pressure to all fabrics 4, 21, 22 and web W. Here again, the high basis weight pillow areas of web W are protected from this pressure as they are within the body of the structured fabric 4. As a result, this pressing arrangement/process does not impact negatively on web quality, but instead increases the drying rate of the boost dryer BD. Boost dryer BD provides sufficient pressure to hold web W against the hot surface of dryer roll 19 thus preventing blistering. The steam that is formed at the knuckle points in structured fabric 4, which passes through woven fabric 22, is condensed on metal fabric 21. Metal fabric 21 is made of a high thermal conductive material and is in contact with cooling jacket 20. This reduces its temperature to well below that of the steam. The condensed water is then captured in woven fabric 22 and subsequently dewatered using a dewatering apparatus 23 after leaving boost dryer roll 19 and before reentering once again.

The invention also contemplates that, depending on the size of boost dryer BD, the need for suction roll 9 can be eliminated. A further option, once again depending on the size of boost dryer BD, is to actually crepe on the surface of boost dryer roll 19 thus eliminating the need for a Yankee Dryer 16.

Figure 6:
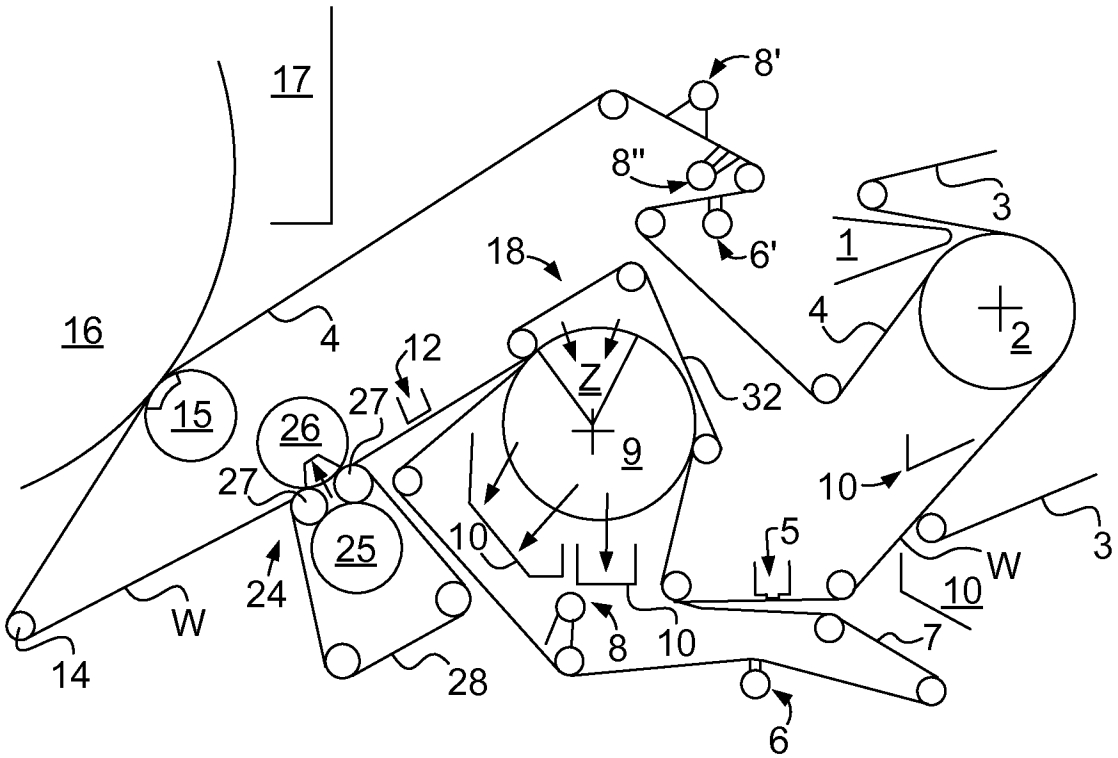

FIG. 6 is yet another embodiment of the Advanced Dewatering System. The system is similar to that of FIG. 3 except that between the suction roll 9 and Yankee roll 16 there is arranged an air press 24. By way of a non-limiting example, air press 24 is a four roll cluster press that is used with high temperature air, i.e., it can be HPTAD. Air press 24 is used for additional web drying prior to the transfer of web W to Yankee roll 16 and the pressing point formed between roll 16 and roll 15. Alternatively, one could use a U-shaped box arrangement as depicted in U.S. Pat. No. 6,454,904 and/or U.S. Pat. No. 6,096,169, the disclosures of which are hereby expressly incorporated by reference in their entireties. Such devices are used for mechanical dewatering, instead of Through Air drying (TAD). As shown in FIG. 6, system 24 or four roll cluster press, includes a main roll 25, a vented roll 26, and two cap rolls 27. The purpose of this cluster is to provide a sealed chamber that is capable of being pressurized. When sealed correctly, there may be a slight pressing effect at each of the roll contact points. This pressing effect is applied only to the raised knuckle points of fabric 4. In this way, the pillow areas of fabric 4 remain protected and sheet quality is maintained. The pressure chamber contains high temperature air, for example, at approximately 150 degrees C. or higher, and is at a significantly higher pressure than conventional Through Air Drying (TAD) technology. The pressure may, for example, be greater than approximately 1.5 PSI resulting a much higher drying rate then a conventional TAD. As a result, less dwell time is required, and HPTAD 24 can be sized significantly smaller than a conventional TAD drum in order to fit easily into the system. In operation, the high pressure hot air passes through an optional air dispersion fabric 28, through sheet W carried on structured fabric 4, and then into vented roll 26. The optional air dispersion fabric 28 may be needed to prevent sheet W from following one of cap rolls 27 in the four roll cluster. Fabric 28 must be very open (i.e., it may have a high air permeability which is greater than or equal an air permeability of structured fabric 4). The drying rate of HPTAD 24 depends of the entering sheet solids level, but is preferably greater than or equal to approximately 500 kg/hr/m$^2$, which represents a rate of at least twice that of conventional TAD machines.

The advantages of the HPTAD system/process are manly in the area of improving sheet dewatering without a significant loss in sheet quality, compactness of size of the system, and improved energy efficiency. The system also provides for higher pre-Yankee solids levels in web W, which increases the speed potential of the inventive system/process. As a result, the invention provides for an increase in the production capacity of the paper machine. Its compact size, for example, means that the HPTAD could easily be retrofit to an existing machine, thereby making it a cost effective option to increase the speed capability of the machine. This would occur without having a negative effect on web quality. The compact size of the HPTAD, and the fact that it is a closed system, also means it can be easily insulated and optimized as a unit whose operation results in an increased energy efficiency.

Figure 7:
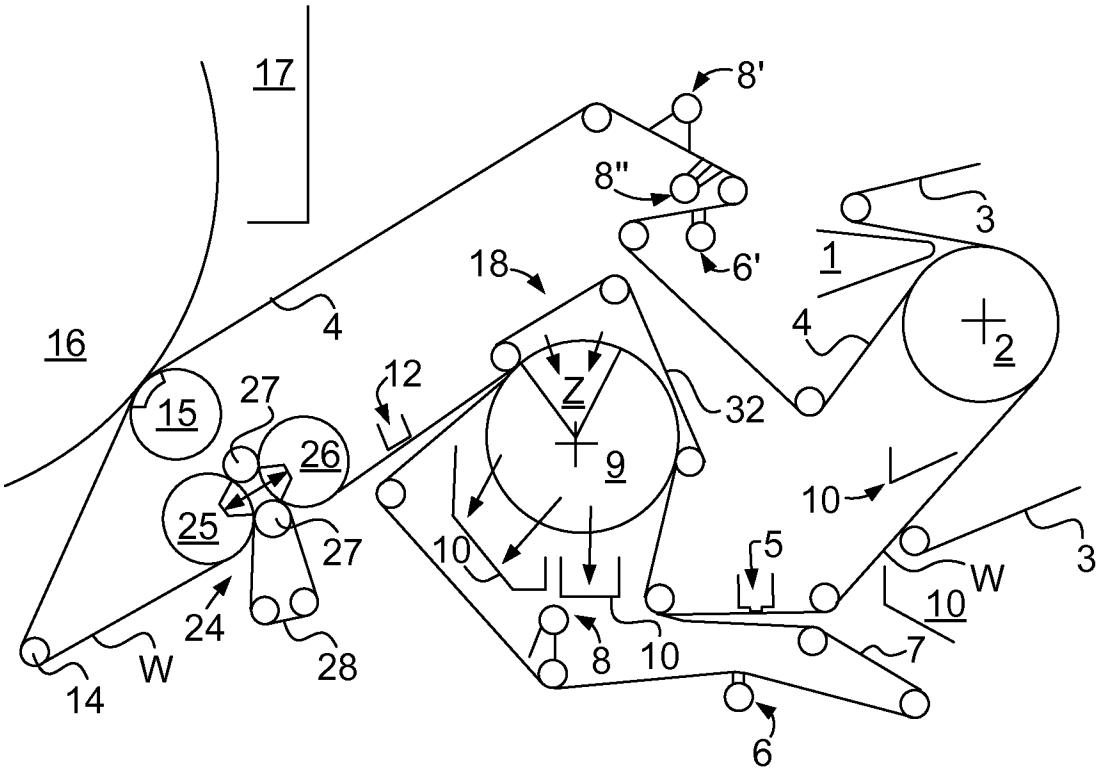

FIG. 7 shows yet another embodiment of an Advanced Dewatering System. The system is similar to that of FIG. 6 and provides for a two pass option for HPTAD 24. Sheet W is carried through the four roll cluster 24 by structured fabric 4. In this case, two vented rolls 26 are used to double its dwell time. An optional air dispersion fabric 28 may be utilized. In operation, hot pressurized air passes through sheet W carried on structured fabric 4 and then into two vent rolls 26. The optional air dispersion fabric 28 may be needed to prevent sheet W from following one of cap rolls 27 in the four roll cluster. In this regard, this fabric 28 needs to be very open (i.e., have a high air permeability that is greater than or equal to the air permeability of impression fabric 4).

Depending on the configuration and size of HPTAD 24, for example, it may have more than one HPTAD 24 arranged in a series, the need for suction roll 9 may be eliminated. The advantages of the two pass HPTAD 24 shown in FIG. 7 are the same as for the one pass system 24 described with regard to FIG. 6 except that the dwell time is essentially doubled.

Figure 8:
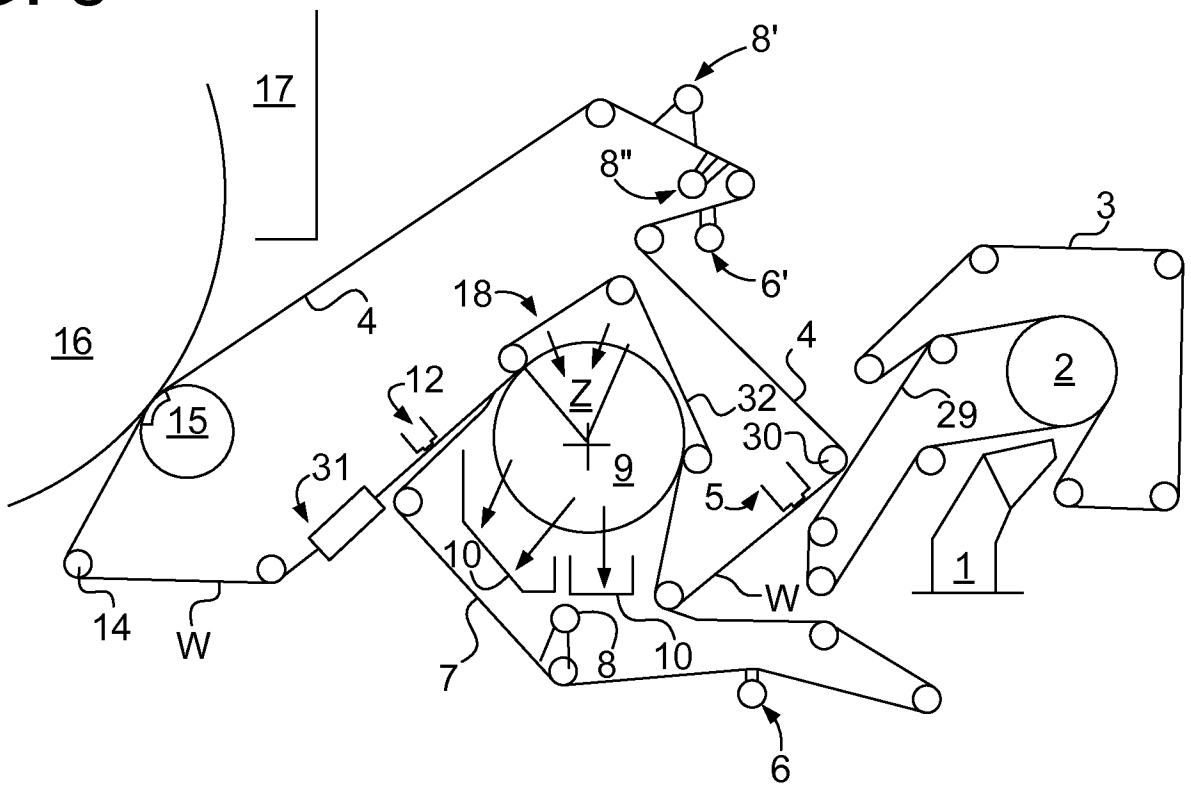

FIG. 8 shows yet another embodiment of the Advanced Dewatering System. In this embodiment, a Twin Wire Former replaces the Crescent Former shown in FIGS. 2-7. Forming roll 2 can be either a solid roll or an open roll. If an open roll is used, care must be taken to prevent significant dewatering through structured fabric 4 to avoid losing fiber density (basis weight) in the pillow areas. The outer wire or forming fabric 3 can be either a standard forming fabric or a DSP belt (e.g., of the type disclosed in U.S. Pat. No. 6,237,644, the disclosure of which is hereby expressly incorporated by reference in its entirety). The inner forming fabric 29 must be a structured fabric, which is much coarser than outer forming fabric 3. Following the twin wire former, web W is subsequently transferred to another structured fabric 4 using a vacuum device 30. Transfer device 30 can be a stationary vacuum shoe or a vacuum assisted rotating pick-up roll. Structured fabric 4 utilizes at least the same coarseness, and preferably is coarser than structured fabric 29. From this point on, the system can use many of the similarly designated features of the embodiments described above including all the various possible options described in the instant application. In this regard, reference number 31 represents possible features such as, e.g., devices 13, BD and 24, described above with regard to FIGS. 2-7. The quality generated from this system/process configuration is competitive with conventional TAD paper systems, but not as great as from the systems/processes previously described. The reason for this is that the high fiber density (basis weight) pillows generated in the forming process will not necessarily be in registration with the new pillows formed during the wet shaping process (vacuum transfer 30 and subsequently the wet molding vacuum box 5). Some of these pillow areas will be pressed, thus losing some of the benefit of this embodiment. However, this system/process option will allow for running a differential speed transfer, which has been shown to improve sheet properties (See e.g., U.S. Pat. No. 4,440,597).

As explained above, FIG. 8 shows an additional dewatering/drying option 31 arranged between suction roll 9 and Yankee roll 17. By way of non-limiting example, device 31 can have the form of a suction box with hot air supply hood, a boost dryer, an HPTAD, and conventional TAD.

It should be noted that conventional TAD is a viable option for a preferred embodiment of the invention. Such an arrangement provides for forming web W on a structured fabric 4 and having web W stay with that fabric 4 until the point of transfer to Yankee 16, depending on its size. Its use, however, is limited by the size of the conventional TAD drum and the required air system. Thus, it is possible to retrofit an exiting conventional TAD machine with a Crescent Former consistent with the invention described herein.

Figure 9:
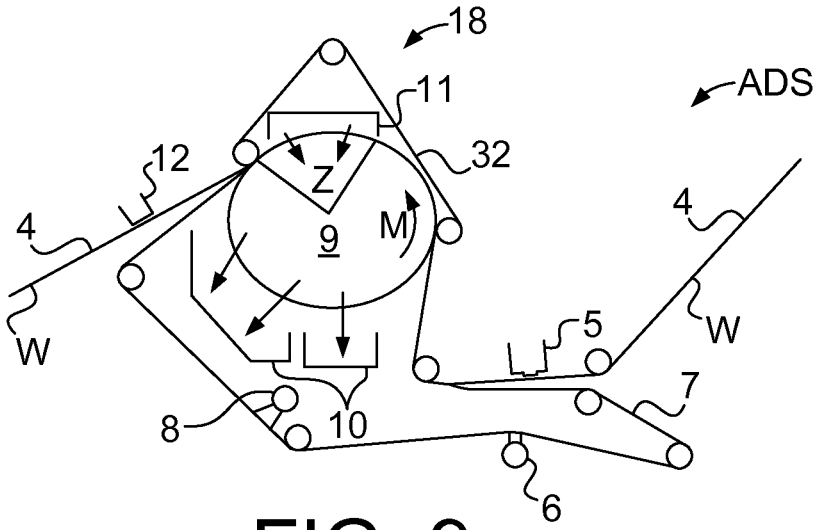
FIG. 9 is a cross-sectional schematic diagram of an advanced dewatering system with an embodiment of a belt press according to the present invention.

FIG. 9 shows still another advanced dewatering system ADS for processing a fibrous web W. System ADS includes a fabric 4, a suction box 5, a vacuum roll 9, a dewatering fabric 7, a belt press assembly 18, a hood 11 (which may be a hot air hood), a pick up suction box 12, a Uhle box 6, one or more shower units 8, and one or more savealls 10. The fibrous material web W enters system ADS generally from the right as shown in FIG. 9. Fibrous web W is a previously formed web (i.e., previously formed by a mechanism of the type described above) that is placed on fabric 4. As is evident from FIG. 9, suction device 5 provides suctioning to one side of web W, while suction roll 9 provides suctioning to an opposite side of web W.

Fibrous web W is moved by fabric 4 in a machine direction M past one or more guide rolls and past a suction box 5. At vacuum box 5, sufficient moisture is removed from web W to achieve a solids level of between approximately 15% and approximately 25% on a typical or nominal 20 gram per square meter (gsm) web running The vacuum at box 5 is between approximately −0.2 to approximately −0.8 bar vacuum, with a preferred operating level of between approximately −0.4 to approximately −0.6 bar.

As fibrous web W proceeds along machine direction M, it comes into contact with a dewatering fabric 7. Dewatering fabric 7 can be an endless circulating belt, which is guided by a plurality of guide rolls and is also guided around a suction roll 9. Dewatering belt 7 can be a dewatering fabric of the type shown and described in FIG. 21 or 22 herein or as described above with regard to the embodiments shown in FIGS. 1-8. Web W then proceeds toward vacuum roll 9 between fabric 4 and dewatering fabric 7. Vacuum roll 9 rotates along machine direction M and is operated at a vacuum level of between approximately −0.2 to approximately −0.8 bar with a preferred operating level of at least approximately −0.4 bar. By way of non-limiting example, the thickness of the vacuum roll shell of roll 9 may be in the range of between approximately 25 mm and approximately 75 mm. An airflow speed through the web W in the area of the suction zone Z is provided. The mean airflow through web W in the area of the suction zone Z can be approximately 150 $m^3$/min per meter machine width. Fabric 4, web W and dewatering fabric 7 guided through a belt press 18 formed by vacuum roll 9 and a permeable belt 32. As is shown in FIG. 9, permeable belt 32 is a single endlessly circulating belt, which is guided by a plurality of guide rolls and which presses against vacuum roll 9 so as to form belt press 18.

The circumferential length of vacuum zone Z can be between approximately 200 mm and approximately 2500 mm, and is preferably between approximately 800 mm and approximately 1800 mm, and an even more preferably between approximately 1200 mm and approximately 1600 mm. The solids leaving vacuum roll 18 in web 12 will vary between approximately 25% to approximately 55% depending on the vacuum pressures and the tension on permeable belt as well as the length of vacuum zone Z and the dwell time of web 12 in vacuum zone Z. The dwell time of web 12 in vacuum zone Z is sufficient to result in this solids range of approximately 25% to approximately 55%.

Figure 10:
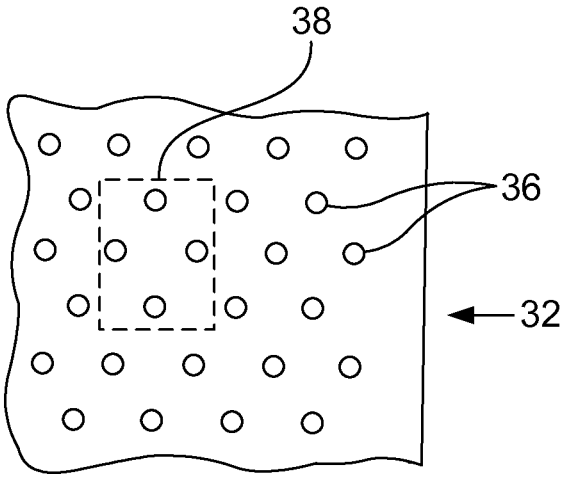
FIG. 10 is a surface view of one side of a permeable belt of the belt press of FIG. 9.
Figure 11:
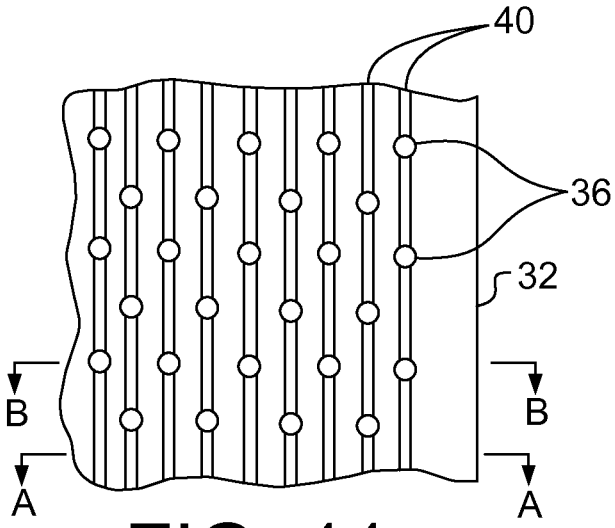
FIG. 11 is a view of an opposite side of the permeable belt of FIG. 10.
Figure 12:
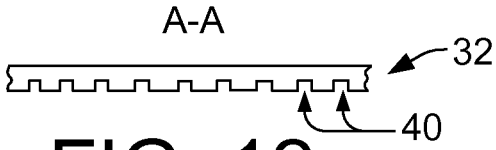
FIG. 12 is cross-section view of the permeable belt of FIGS. 10 and 11.
Figure 13:
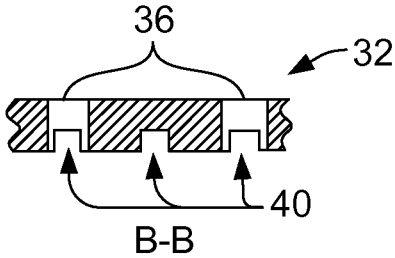
FIG. 13 is an enlarged cross-sectional view of the permeable belt of FIGS. 10-12.

With reference to FIGS. 10-13, there is shown details of one embodiment of the permeable belt 32 of belt press 18. Belt 32 includes a plurality of through holes or through openings 36. Holes 36 are arranged in a hole pattern 38, of which FIG. 10 illustrates one non-limiting example thereof. As illustrated in FIGS. 11-13, belt 32 includes grooves 40 arranged on one side of belt 32, i.e., the outside of belt 32 or the side which contacts fabric 4. Permeable belt 32 is routed so as to engage an upper surface of fabric 4 and thereby acts to press fabric 4 against web W in belt press 18. This, in turn, causes web W to be pressed against fabric 7, which is supported thereunder by vacuum roll 9. As this temporary coupling or pressing engagement continues around vacuum roll 9 in the machine direction M, it encounters a vacuum zone Z. Vacuum zone Z receives air flow from hood 11, which means that air passes from hood 11, through permeable belt 32, through fabric 4, and through drying web W and finally through belt 7 and into zone Z. In this way, moisture is picked up from web W and is transferred through fabric 7 and through a porous surface of vacuum roll 9. As a result, web W experiences or is subjected to both pressing and airflow in a simultaneous manner. Moisture drawn or directed into vacuum roll 9 mainly exits by way of a vacuum system (not shown). Some of the moisture from the surface of roll 9, however, is captured by one or more savealls 10 which are located beneath vacuum roll 9. As web W leaves belt press 18, fabric 7 is separated from web W, and web W continues with fabric 4 past vacuum pick up device 12. Device 12 additionally suctions moisture from fabric 4 and web W so as to stabilize web W.

Fabric 7 proceeds past one or more shower units 8. These units 8 apply moisture to fabric 7 in order to clean fabric 7. Fabric 7 then proceeds past a Uhle box 6, which removes moisture from fabric 7.

Fabric 4 can be a structured fabric 14, having a three dimensional structure that is reflected in web W, thicker pillow areas of the web W are formed. These pillow areas are protected during pressing in belt press 18 because they are within the body of structured fabric 4. As such, the pressing imparted by belt press assembly 18 upon the web W does not negatively impact web or sheet quality. At the same time, it increases the dewatering rate of vacuum roll 9. If belt 32 is used in a No Press/Low Press apparatus, the pressure can be transmitted through a dewatering fabric, also known as a press fabric. In such a case, web W is not protected with a structured fabric 4. However, the use of belt 32 is still advantageous because the press nip is much longer than a conventional press, which results in a lower specific pressure and less or reduced sheet compaction of web W.

Permeable belt 32 shown in FIGS. 10-13 can of the same type as described above with regard to belt 32 of FIGS. 1 and 3-8 and can provide a low level of pressing in the range of between approximately 30 KPa and approximately 150 KPa, and preferably greater than approximately 100 KPa. Thus, if the suction roll 9 has a diameter of 1.2 meter, the fabric tension for belt 32 can be greater than approximately 30 KN/m, and preferably greater than approximately 50 KN/m. The pressing length of permeable belt 32 against fabric 4, which is indirectly supported by vacuum roll 9, can be at least as long as or longer than the circumferential length of the suction zone Z of roll 9. Of course, the invention also contemplates that the contact portion of permeable belt 32 (i.e., the portion of belt which is guided by or over the roll 9) can be shorter than suction zone Z.

Figure 13A:
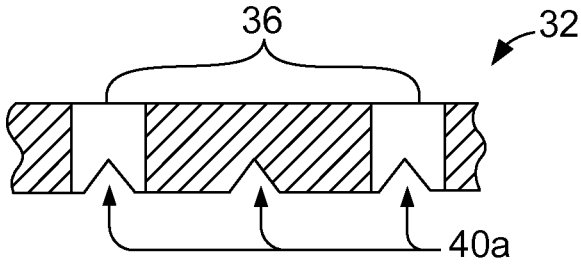
FIG. 13*a* is an enlarged cross-sectional view of the permeable belt of FIGS. 10-12 and illustrating optional triangular grooves.
Figure 13B:
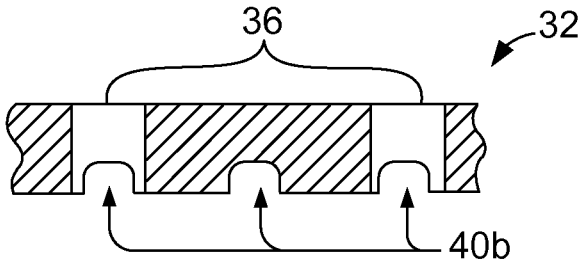
FIG. 13*b* is an enlarged cross-sectional view of the permeable belt of FIGS. 10-12 and illustrating optional semi-circular grooves.
Figure 13C:
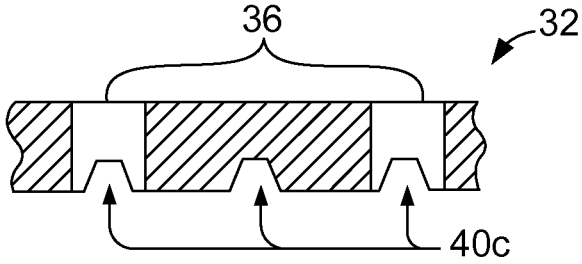
FIG. 13*c* is an enlarged cross-sectional view of the permeable belt of FIGS. 10-12 illustrating optional trapezoidal grooves.

As is shown in FIGS. 10-13, the permeable belt 32 has a pattern 38 of through holes 36, which may, for example, be formed by drilling, laser cutting, etched formed, or woven therein. Permeable belt 32 may also be essentially monoplaner, i.e., formed without grooves 40 shown in FIGS. 11-13. The surface of belt 32, which has grooves 40, can be placed in contact with fabric 4 along a portion of the travel of permeable belt 32 in a belt press 18. Each groove 40 connects with a set or row of holes 36 so as to allow the passage and distribution of air in belt 34. Air is thus distributed along grooves 40. Grooves 40 and openings 36 thus constitute open areas of belt 32 and are arranged adjacent to contact areas, i.e., areas where the surface of belt 32 applies pressure against the fabric 4 or web W. Air enters permeable belt 32 through holes 36 from a side opposite that of the side containing grooves 40, and then migrates into and along grooves 40 and also passes through fabric 4, web W and fabric 7. As can be seen in FIG. 11, the diameter of holes 36 is larger than the width of grooves 40. While circular holes 36 are preferred, they need not be circular and can have any shape or configuration, which performs the intended function. Moreover, although grooves 40 are shown in FIG. 13 as having a generally rectangular cross-section, grooves 40 may have a different cross-sectional contour, such as, e.g., a triangular cross-section as shown in FIG. 13*a*, a trapezoidal cross-section as shown in FIG. 13*c*, and a semicircular or semi-elliptical cross-section as shown in FIG. 13*b*. The combination of the permeable belt 32 and vacuum roll 9, is a combination that has been shown to increase sheet solids level by at least 15%.

By way of non-limiting example, the width of the generally parallel grooves 40 shown in FIG. 11 can be approximately 2.5 mm and the depth of grooves 40 measured from the outside surface (i.e., surface contacting belt 14) can be approximately 2.5 mm. The diameter of the through openings 36 can be approximately 4 mm. The distance, measured (of course) in the width direction, between the grooves 40 can be approximately 5 mm. The longitudinal distance (measured from the center-lines) between openings 36 can be approximately 6.5 mm. The distance (measured from the center-lines in a direction of the width) between openings 36, rows of openings, or grooves 40 can be approximately 7.5 mm. Openings 36 in every other row of openings can be offset by approximately half so that the longitudinal distance between adjacent openings can be half the distance between openings 36 of the same row, e.g., half of 6.5 mm. The overall width of belt 32 can be approximately 1050 mm and the overall length of the endlessly circulating belt 32 can be approximately 8000 mm.

FIGS. 14-19 show other non-limiting embodiments of permeable belt 32 which can be used in a belt press 18 of the type shown in FIG. 9. Belt 32 shown FIGS. 14-17 may be an extended nip press belt made of a flexible reinforced polyurethane 42. It may also be a spiral link fabric 48 of the type shown in FIGS. 18 and 19. Permeable belt 32 shown in FIGS. 14-17 also provides a low level of pressing in the range of between approximately 30 and approximately 150 KPa, and preferably greater than approximately 100 KPa. This allows, for example, a suction roll with a 1.2 meter diameter to provide a fabric tension of greater than approximately 30 KN/m, and preferably greater than approximately 50 KN/m. The pressing length of permeable belt 32 against fabric 4, which is indirectly supported by vacuum roll 9, can be at least as long as or longer than suction zone Z in roll 9. Of course, the invention also contemplates that the contact portion of permeable belt 32 can be shorter than suction zone Z.

Figure 14:
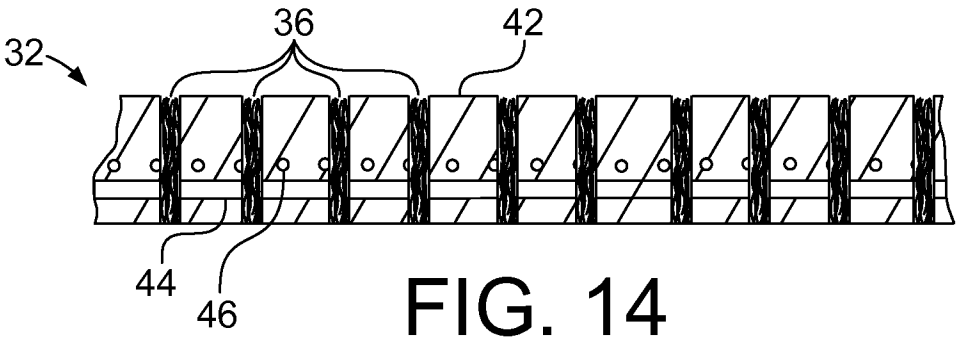
FIG. 14 is a cross-sectional view of the permeable belt of FIG. 11 along section line B-B.
Figure 15:
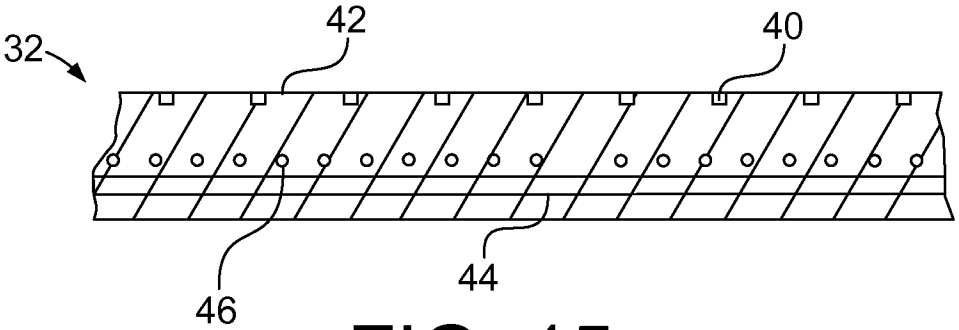
FIG. 15 is a cross-sectional view of the permeable belt of FIG. 11 along section line A-A.

With reference to FIGS. 14 and 15, belt 32 can have the form of a polyurethane matrix 42, which has a permeable structure. The permeable structure can have the form of a woven structure with reinforcing machine direction yarns 44 and cross direction yarns 46 at least partially embedded within polyurethane matrix 42. Belt 32 also includes through holes 36 and generally parallel longitudinal grooves 40 which connect the rows of openings as in the embodiment shown in FIGS. 11-13.

Figure 16:
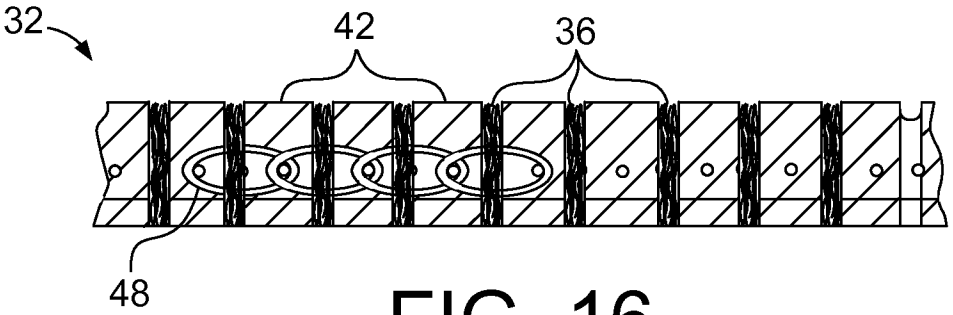
FIG. 16 is a cross-sectional view of another embodiment of the permeable belt of FIG. 11 along section line B-B.
Figure 17:
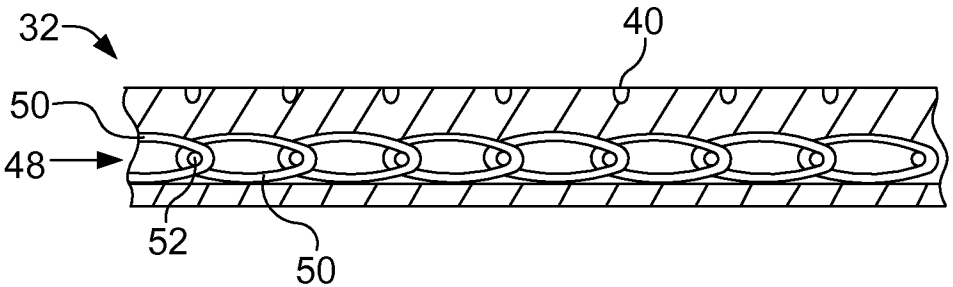
FIG. 17 is a cross-sectional view of another embodiment of the permeable belt of FIG. 11 along section line A-A.

FIGS. 16 and 17 illustrate still another embodiment for belt 32. Belt 32 includes a polyurethane matrix 42, which has a permeable structure in the form of a spiral link fabric 48. Fabric 48 at least partially embedded within polyurethane matrix 42. Holes 36 extend through belt 32 and may at least partially sever portions of spiral link fabric 48. Generally parallel longitudinal grooves 40 also connect the rows of openings and in the above-noted embodiments.

By way of a non-limiting example, and with reference to the embodiments shown in FIGS. 14-17, the width of the generally parallel grooves 40 shown in FIG. 15 can be approximately 2.5 mm and the depth of the grooves 40 measured from the outside surface (i.e., the surface contacting belt 14) can be approximately 2.5 mm. The diameter of the through openings 36 can be approximately 4 mm. The distance, measured (of course) in the width direction, between grooves 40 can be approximately 5 mm. The longitudinal distance (measured from the center-lines) between the openings 36 can be approximately 6.5 mm. The distance (measured from the center-lines in a direction of the width) between openings 36, rows of openings, or grooves 40 can be approximately 7.5 mm. Openings 36 in every other row of openings can be offset by approximately half so that the longitudinal distance between adjacent openings can be half the distance between openings 36 of the same row, e.g., half of 6.5 mm. The overall width of belt 32 can be approximately 1050 mm and the overall length of the endlessly circulating belt 32 can be approximately 8000 mm.

Figure 18:
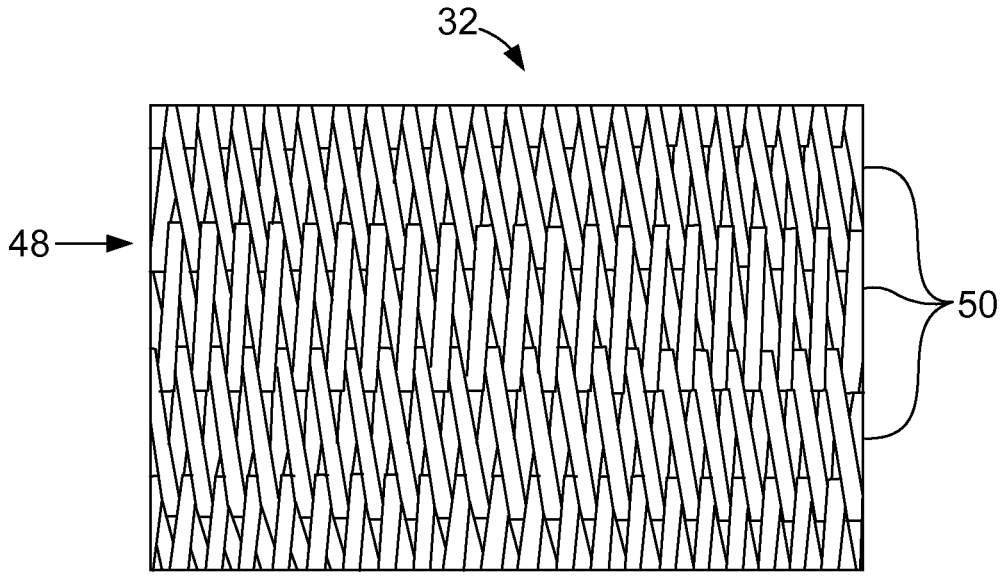
FIG. 18 is a surface view of another embodiment of the permeable belt of the present invention.
Figure 19:
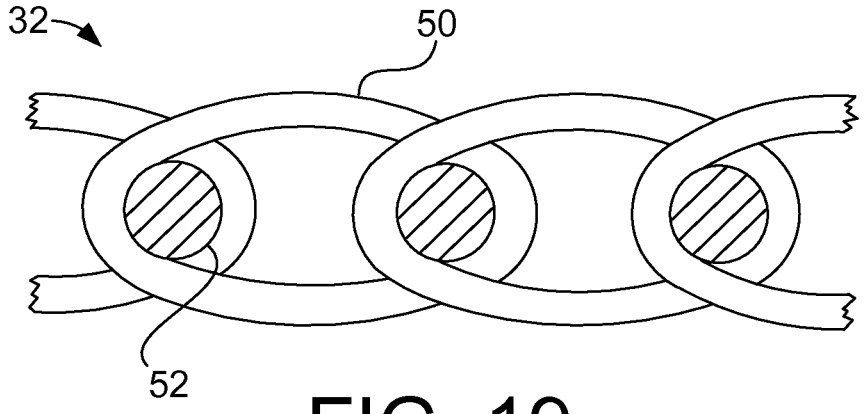
FIG. 19 is a side view of a portion of the permeable belt of FIG. 18.

FIGS. 18 and 19 shows yet another embodiment of permeable belt 32. In this embodiment, yarns 50 are interlinked by entwining generally spiral woven yarns 50 with cross yarns 52 in order to form link fabric 48.

As with the previous embodiments, permeable belt 32 shown in FIGS. 18 and 19 is capable of running at high running tensions of between at least approximately 30 KN/m and at least approximately 50 KN/m or higher and may have a surface contact area of approximately 10% or greater, as well as an open area of approximately 15% or greater. The contact area may be approximately 25% or greater, and the open area may be approximately 25% or greater. Preferably, permeable belt 32 will have an open area between approximately 50%, and 85%. The composition of permeable belt 32 shown in FIGS. 18 and 19 may include a thin spiral link structure having a support layer within permeable belt 32. Further, permeable belt 32 may be a spiral link fabric having a contact area of between approximately 10% and approximately 40%, and an open area of between approximately 60% to approximately 90%.

The process of using the advanced dewatering system ADS shown in FIG. 9 will now be described. The ADS utilizes belt press 182 to remove water from web W after the web is initially formed prior to reaching belt press 18. A permeable belt 32 is routed in belt press 18 so as to engage a surface of fabric 4 and thereby press fabric 4 further against web W, thus pressing web W against fabric 7, which is supported thereunder by a vacuum roll 7. The physical pressure applied by belt 32 places some hydraulic pressure on the water in web W causing it to migrate toward fabrics 4 and 7. As this coupling of web W with fabrics 4 and 7, and belt 32 continues around vacuum roll 9, in machine direction M, it encounters a vacuum zone Z through which air is passed from a hood 11, through permeable belt 32, through fabric 4, so as to subject web W to drying. The moisture picked up by the airflow from web W proceeds further through fabric 7 and through a porous surface of vacuum roll 9. In permeable belt 32, the drying air from hood 11 passes through holes 36, is distributed along grooves 40 before passing through fabric 4. As web W leaves belt press 18, belt 32 separates from fabric 4. Shortly thereafter, fabric 7 separates from web W, and web W continues with fabric 4 past vacuum pick up unit 12, which additionally suctions moisture from fabric 4 and web W.

Permeable belt 32 of the present invention is capable of applying a line force over an extremely long nip, thereby ensuring a long dwell time in which pressure is applied against web W as compared to a standard shoe press. This results in a much lower specific pressure, thereby reducing the sheet compaction and enhancing sheet quality. The present invention further allows for a simultaneous vacuum and pressing dewatering with airflow through the web at the nip itself.

Figure 20:
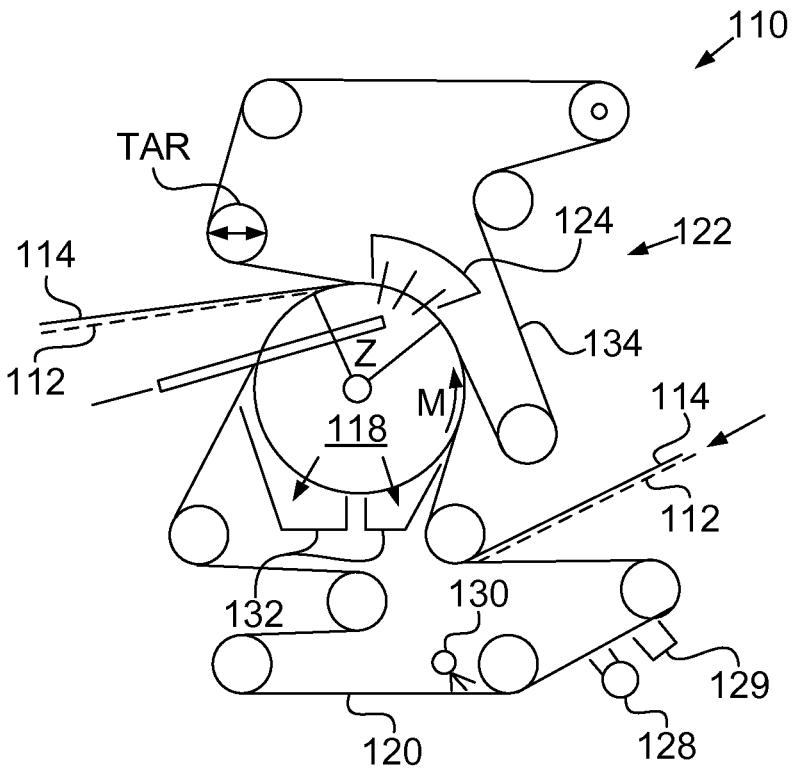
FIG. 20 is a cross-sectional schematic diagram of still another advanced dewatering system with an embodiment of a belt press according to the present invention.

FIG. 20 shows another an advanced dewatering system 110 for processing a fibrous web 112. System 110 includes an upper fabric 114, a vacuum roll 118, a dewatering fabric 120, a belt press assembly 122, a hood 124 (which may be a hot air hood), a Uhle box 128, one or more shower units 130, one or more savealls 132, one or more heater units 129. Fibrous material web 112 enters system 110 generally from the right as shown in FIG. 12. Fibrous web 112 is a previously formed web (i.e., previously formed by a mechanism not shown), which is placed on fabric 114. As was the case in FIG. 9, a suction device (not shown but similar to device 16 in FIG. 9) can provide suctioning to one side of web 112, while suction roll 118 provides suctioning to an opposite side of web 112.

Fibrous web 112 is moved by fabric 114 in a machine direction M past one or more guide rolls. Although it may not be necessary, before reaching the suction roll, web 112 may have sufficient moisture is removed from web 112 to achieve a solids level of between approximately 15% and approximately 25% on a typical or nominal 20 gram per square meter (gsm) web running. This can be accomplished by vacuum at a box (not shown) of between approximately −0.2 to approximately −0.8 bar vacuum, with a preferred operating level of between approximately −0.4 to approximately −0.6 bar.

As fibrous web 112 proceeds along machine direction M, it comes into contact with a dewatering fabric 120. Dewatering fabric 120 can be an endless circulating belt, which is guided by a plurality of guide rolls and is also guided around a suction roll 118. Web 112 then proceeds toward vacuum roll 118 between fabric 114 and dewatering fabric 120. Vacuum roll 118 can be a driven roll which rotates along machine direction M and is operated at a vacuum level of between approximately −0.2 to approximately −0.8 bar with a preferred operating level of at least approximately −0.4 bar. By way of non-limiting example, the thickness of the vacuum roll shell of roll 118 may be in the range of between 25 mm and 50 mm. An airflow speed is provided through web 112 in the area of suction zone Z. Fabric 114, web 112 and dewatering fabric 120 is guided through a belt press 122 formed by vacuum roll 118 and a permeable belt 134. As is shown in FIG. 12, permeable belt 134 is a single endlessly circulating belt, which is guided by a plurality of guide rolls and which presses against vacuum roll 118 so as to form belt press 122. To control and/or adjust the tension of belt 134, a tension adjusting roll TAR is provided as one of the guide rolls.

The circumferential length of vacuum zone Z can be between approximately 200 mm and approximately 2500 mm, and is preferably between approximately 800 mm and approximately 1800 mm, and an even more preferably between approximately 1200 mm and approximately 1600 mm. The solids leaving vacuum roll 118 in web 112 will vary between approximately 25% to approximately 55% depending on the vacuum pressures and the tension on permeable belt as well as the length of vacuum zone Z and the dwell time of web 112 in vacuum zone Z. The dwell time of web 112 in vacuum zone Z is sufficient to result in this solids range of approximately 25% to approximately 55%.

The press system shown in FIG. 20 thus utilizes at least one upper or first permeable belt or fabric 114, at least one lower or second belt or fabric 120 and a paper web 112 disposed therebetween, thereby forming a package which can be led through belt press 122 formed by roll 118 and permeable belt 134. A first surface of a pressure producing element 134 is in contact with the at least one upper fabric 114. A second surface of a supporting structure 118 is in contact with the at least one lower fabric 120 and is permeable. A differential pressure field is provided between the first and the second surfaces, acting on the package of at least one upper and at least one lower fabric and the paper web therebetween. In this system, a mechanical pressure is produced on the package and therefore on paper web 112. This mechanical pressure produces a predetermined hydraulic pressure in web 112, whereby the contained water is drained. The upper fabric 114 has a bigger roughness and/or compressibility than lower fabric 120. An airflow is caused in the direction from the at least one upper 114 to the at least one lower fabric 120 through the package of at least one upper fabric 114, at least one lower fabric 120 and paper web 112 therebetween.

Upper fabric 114 can be permeable and/or a so-called "structured fabric". By way of non-limiting examples, upper fabric 114 can be e.g., a TAD fabric. Hood 124 can also be replaced with a steam box, which has a sectional construction or design in order to influence the moisture or dryness cross-profile of the web.

Figure 21:
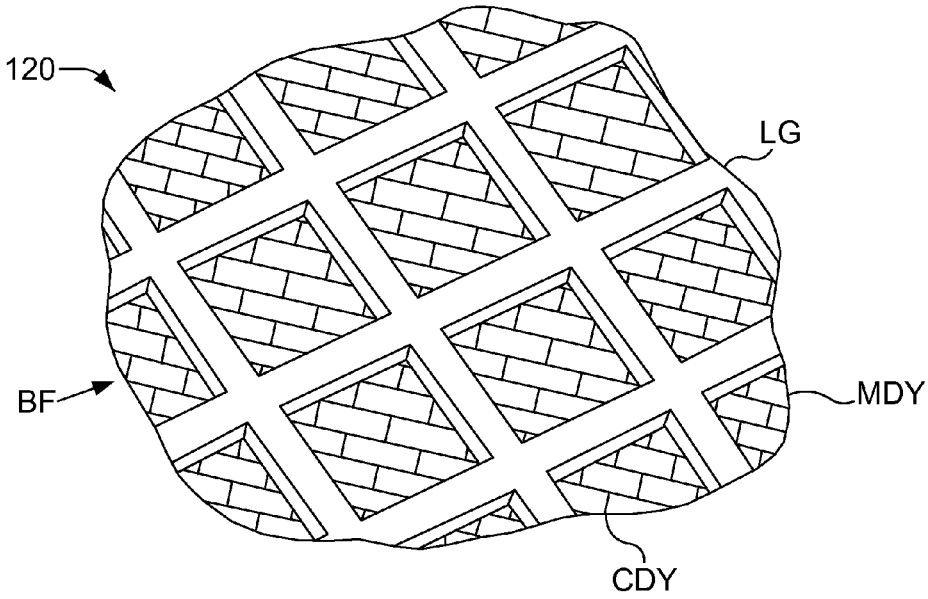
FIG. 21 is an enlarged partial view of one dewatering fabric that can be used on the advanced dewatering systems of the present invention.

With reference to FIG. 21, lower fabric 120 can be a membrane or fabric, which includes a permeable base fabric BF, and a lattice grid LG attached thereto and which is made of polymer such as polyurethane. Lattice grid LG side of fabric 120 can be in contact with suction roll 118 while the opposite side contacts paper web 112. Lattice grid LG may be attached or arranged on the base fabric BF by utilizing various known procedures, such as, for example, an extrusion technique or a screen printing technique. As shown in FIG. 21, lattice grid LG can also be oriented at an angle relative to machine direction yarns MDY and cross-direction yarns CDY.

Figure 22:
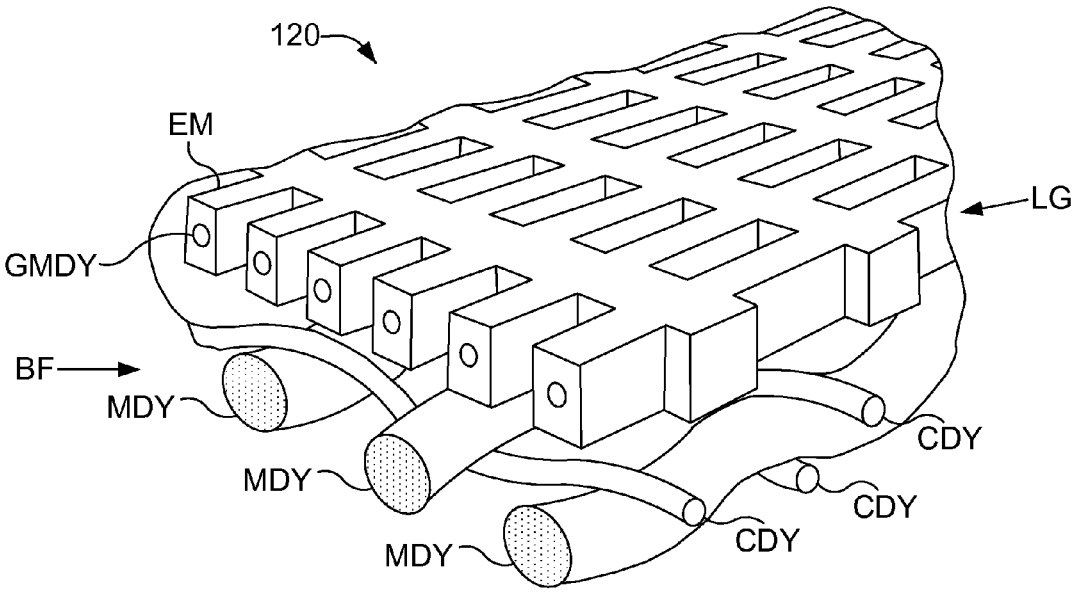
FIG. 22 is an enlarged partial view of another dewatering fabric that can be used on the advanced dewatering systems of the present invention.

Although this orientation is such that no part of lattice grid LG is aligned with the machine direction yarns MDY, other orientations such as that shown in FIG. 22 can also be utilized. Although lattice grid LG is shown as a rather uniform grid pattern, this pattern can also be discontinuous and/or non-symmetrical at least in part. Further, the material between the interconnections of the lattice structure may take a circuitous path rather than being substantially straight, as is shown in FIG. 21. Lattice grid LG can also be made of a synthetic, such as a polymer or specifically a polyurethane, which attaches itself to the base fabric BF by its natural adhesion properties. Making lattice grid LG of a polyurethane provides it with good frictional properties, such that it seats well against vacuum roll 118. This, then forces vertical airflow and eliminates any "x,y plane" leakage. The velocity of the air is sufficient to prevent any re-wetting once the water makes it through lattice grid LG. Additionally, lattice grid LG may be a thin perforated hydrophobic film having an air permeability of approximately 35 cfm or less, preferably approximately 25 cfm. The pores or openings of lattice grid LG can be approximately 15 microns. Lattice grid LG can thus provide good vertical airflow at high velocity so as to prevent rewet. With such a fabric 120, it is possible to form or create a surface structure that is independent of the weave patterns.

With reference to FIG. 22, it can be seen that lower dewatering fabric 120 can have a side that contacts vacuum roll 118 which also includes a permeable base fabric BF and a lattice grid LG. The base fabric BF includes machine direction multifilament yarns MDY and cross-direction multifilament yarns CDY and is adhered to lattice grid LG, so as to form a so called "anti-rewet layer". The lattice grid can be made of a composite material, such as an elastomeric material, which may be the same as the as the lattice grid described in FIG. 21. As can be seen in FIG. 22, Lattice grid LG can itself include machine direction yarns GMDY with an elastomeric material EM being formed around these yarn. Lattice grid LG may thus be composite grid mat formed on elastomeric material EM and machine direction yarns GMDY. In this regard, the grid machine direction yarns GMDY may be pre-coated with elastomeric material EM before being placed in rows that are substantially parallel in a mold that is used to reheat the elastomeric material EM causing it to re-flow into the pattern shown as grid LG in FIG. 22. Additional elastomeric material EM may be put into the mold as well. Grid structure LG, as forming the composite layer, in then connected to base fabric BF by one of many techniques including the laminating of grid LG to the permeable base fabric BF, melting the elastomeric coated yarn as it is held in position against permeable base fabric BF or by re-melting grid LG to the permeable base fabric BF. Additionally, an adhesive may be utilized to attach grid LG to permeable base fabric BF. Composite layer LG should be able to seal well against vacuum roll 118 preventing "x, y plane" leakage and allowing vertical airflow to prevent rewet. With such a fabric, it is possible to form or create a surface structure that is independent of the weave patterns.

Belt 120 shown in FIGS. 21 and 22 can also be used in place of belt 20 shown in the arrangement of FIG. 9.

Figure 23:
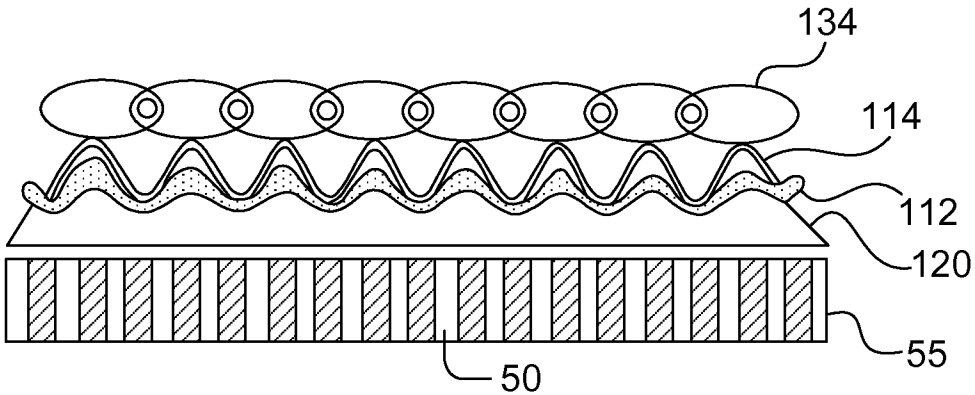
FIG. 23 is an exaggerated cross-sectional schematic diagram of one embodiment of a pressing portion of the advanced dewatering system according to the present invention.
Figure 24:
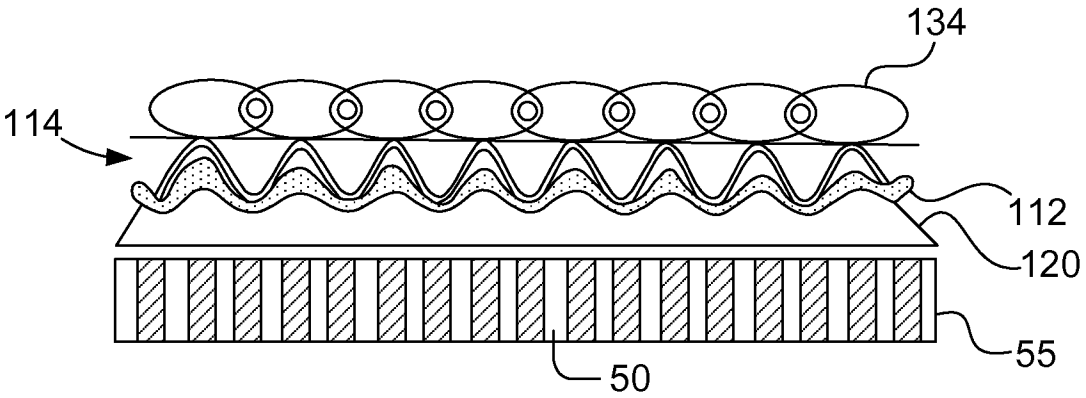
FIG. 24 is a exaggerated cross-sectional schematic diagram of another embodiment of a pressing portion of the advanced dewatering system according to the present invention.

FIG. 23 show an enlargement of one possible arrangement in a press. A suction support surface SS acts to support fabrics 120,114, 134 and web 112. Suction support surface SS has suction openings SO. Surface SS may be generally flat in the case of a suction arrangement which uses a suction box of the type shown in, e.g., FIG. 24. Preferably, suction surface SS is a moving curved roll belt or jacket of suction roll 118. In this case, belt 134 can be a tensioned spiral link belt of the type already described herein. Belt 114 can be a structured fabric and belt 120 can be a dewatering felt of the types described above. In this arrangement, moist air is drawn from above belt 134 and through belt 114, web 112, and belt 120 and finally through openings SO and into suction roll 118. Another possibility shown in FIG. 24 provides for suction surface SS to be a moving curved roll belt or jacket of suction roll 118 and belt 114 to be a SPECTRA membrane. In this case, belt 134 can be a tensioned spiral link belt of the type already described herein. Belt 120 can be a dewatering felt of the types described above. In this arrangement, also moist air is drawn from above belt 134 and through belt 114, web 112, and belt 120 and finally through openings SO and into suction roll 118.

Figure 25:
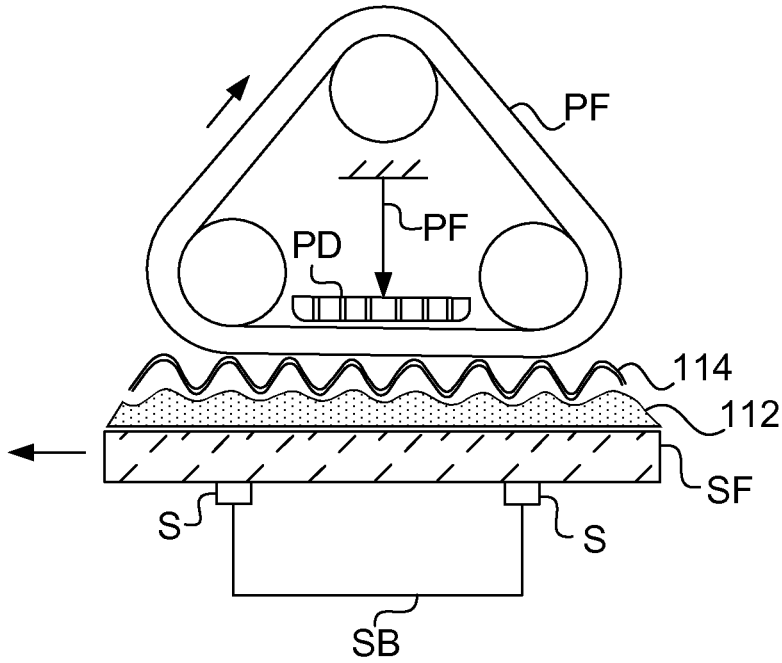
FIG. 25 is a cross-sectional schematic diagram of still another advanced dewatering system with another embodiment of a belt press according to the present invention.
Figure 26:
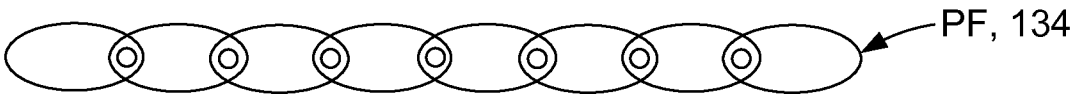
FIG. 26 is a partial side view of an optional permeable belt that may be used in the advanced dewatering systems of the present invention.
Figure 27:
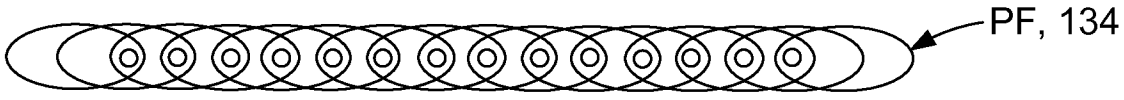
FIG. 27 is a partial side view of another optional permeable belt that may be used in the advanced dewatering systems of the present invention.

FIG. 25 illustrates another way in which web 112 can be subjecting to drying. In this case, a permeable support fabric SF (which can be similar to fabrics 20 or 120) is moved over a suction box SB. Suction box SB is sealed with seals S to an underside surface of belt SF. A support belt 114 has the form of a TAD fabric and carries web 112 into the press formed by belt PF, and pressing device PD arranged therein, and support belt SF and stationary suction box SB. Circulating pressing belt PF can be a tensioned spiral link belt of the type already described herein and/or of the type shown in FIGS. 26 and 27. Belt PF can also alternatively be a groove belt and/or it can also be permeable. In this arrangement, pressing device PD presses belt PF with a pressing force PF against belt SF while suction box SB applies a vacuum to belt SF, web 112 and belt 114. During pressing, moist air can be drawn from at least belt 114, web 112 and belt SF and finally into suction box SB.

Upper fabric 114 can thus transport web 112 to and away from the press and/or pressing system. Web 112 can lie in the three-dimensional structure of upper fabric 114, and therefore it is not flat, but instead has also a three-dimensional structure, which produces a high bulky web. Lower fabric 120 is also permeable. The design of lower fabric 120 is made to be capable of storing water. Lower fabric 120 also has a smooth surface. Lower fabric 120 is preferably a felt with a batt layer. The diameter of the batt fibers of lower fabric 120 can be equal to or less than approximately 11 dtex, and can preferably be equal to or lower than approximately 4.2 dtex, or more preferably be equal to or less than approximately 3.3 dtex. The batt fibers can also be a blend of fibers. Lower fabric 120 can also contain a vector layer which contains fibers from at least approximately 67 dtex, and can also contain even courser fibers such as, e.g., at least approximately 100 dtex, at least approximately 140 dtex, or even higher dtex numbers. This is important for the good absorption of water. The wetted surface of the batt layer of lower fabric 120 and/or of lower fabric 120 itself can be equal to or greater than approximately 35 $m^2/m^2$ felt area, and can preferably be equal to or greater than approximately 65 $m^2/m^2$ felt area, and can most preferably be equal to or greater than approximately 100 $m^2/m^2$ felt area. The specific surface of lower fabric 120 should be equal to or greater than approximately 0.04 $m^2/g$ felt weight, and can preferably be equal to or greater than approximately 0.065 $m^2/g$ felt weight, and can most preferably be equal to or greater than approximately 0.075 $m^2/g$ felt weight. This is important for the good absorption of water.

The compressibility (thickness change by force in mm/N) of upper fabric 114 is lower than that of lower fabric 120. This is important in order to maintain the three-dimensional structure of the web 112, i.e., to ensure that upper belt 114 is a stiff structure.

The resilience of lower fabric 120 should be considered. The density of lower fabric 120 should be equal to or higher than approximately 0.4 $g/cm^3$, and is preferably equal to or higher than approximately 0.5 $g/cm^3$, and is ideally equal to or higher than approximately 0.53 $g/cm^3$. This can be advantageous at web speeds of greater than 1200 m/min. A reduced felt volume makes it easier to take the water away from felt 120 by the air flow, i.e., to get the water through felt 120. Therefore the dewatering effect is smaller. The permeability of lower fabric 120 can be lower than approximately 80 cfm, preferably lower than 40 cfm, and ideally equal to or lower than 25 cfm. A reduced permeability makes it easier to take the water away from felt 120 by the air flow, i.e., to get the water through felt 120. As a result, the re-wetting effect is smaller. A too high permeability, however, would lead to a too high air flow, less vacuum level for a given vacuum pump, and less dewatering of the felt because of the too open structure.

Figure 28:
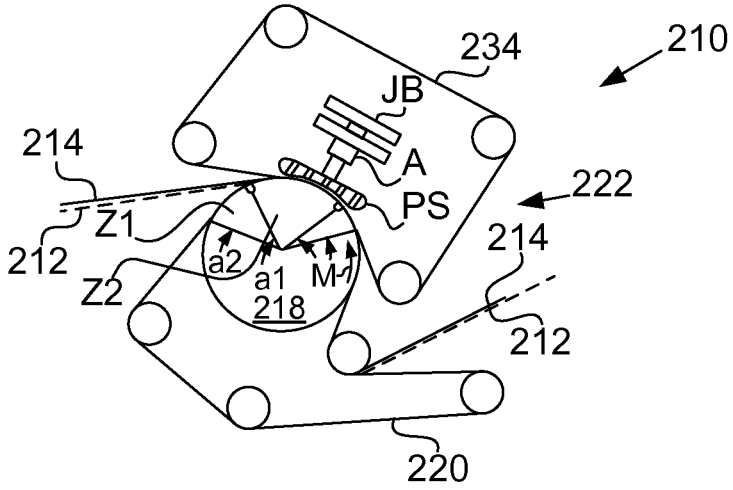
FIG. 28 is a cross-sectional schematic diagram of still another advanced dewatering system with an embodiment of a belt press that uses a pressing shoe according to the present invention.

The second surface of the supporting structure, i.e., the surface supporting belt 120, can be flat and/or planar. In this regard, the second surface of supporting structure SF can be formed by a flat suction box SB. The second surface of supporting structure SF can preferably be curved. For example, the second surface of supporting structure SS can be formed or run over a suction roll 118 or cylinder whose diameter is, e.g., approximately g.t. 1 m. The suction device or cylinder 118 may include at least one suction zone Z. It may also include two suction zones Z1 and Z2 as is shown in FIG. 28. Suction cylinder 218 may also include at least one suction box with at least one suction arc. At least one mechanical pressure zone can be produced by at least one pressure field (i.e., by the tension of a belt) or through the first surface by, e.g., a press element. The first surface can be an impermeable belt 134, but with an open surface towards first fabric 114, e.g., a grooved or a blind drilled and grooved open surface, so that air can flow from outside into the suction arc. The first surface can be a permeable belt 134. The belt may have an open area of at least approximately 25%, preferably greater than approximately 35%, most preferably greater than approximately 50%. Belt 134 may have a contact area of at least approximately 10%, at least approximately 25%, and preferably up to approximately 50% in order to have a good pressing contact.

FIG. 28 shows another an advanced dewatering system 210 for processing a fibrous web 212. System 210 includes an upper fabric 214, a vacuum roll 218, a dewatering fabric 220 and a belt press assembly 222. Other optional features which are not shown include a hood (which may be a hot air hood), one or more Uhle boxes, one or more shower units, one or more savealls, and one or more heater units, as is shown in FIGS. 9 and 20. Fibrous material web 212 enters system 210 generally from the right as shown in FIG. 28. Fibrous web 212 is a previously formed web (i.e., previously formed by a mechanism not shown), which is placed on fabric 214. As was the case in FIG. 9, a suction device (not shown but similar to device 16 in FIG. 9) can provide suctioning to one side of web 212, while suction roll 218 provides suctioning to an opposite side of web 212.

Fibrous web 212 is moved by fabric 214, which may be a TAD fabric, in a machine direction M past one or more guide rolls. Although it may not be necessary, before reaching suction roll 218, web 212 may have sufficient moisture is removed from web 212 to achieve a solids level of between approximately 15% and approximately 25% on a typical or nominal 20 gram per square meter (gsm) web running. This can be accomplished by vacuum at a box (not shown) of between approximately −0.2 to approximately −0.8 bar vacuum, with a preferred operating level of between approximately −0.4 to approximately −0.6 bar.

As fibrous web 212 proceeds along machine direction M, it comes into contact with a dewatering fabric 220. Dewatering fabric 220 (which can be any type described herein) can be endless circulating belt, which is guided by a plurality of guide rolls and is also guided around a suction roll 218. Web 212 then proceeds toward vacuum roll 218 between fabric 214 and dewatering fabric 220. Vacuum roll 218 can be a driven roll which rotates along machine direction M and is operated at a vacuum level of between approximately −0.2 to approximately −0.8 bar with a preferred operating level of at least approximately −0.4 bar. By way of non-limiting example, the thickness of the vacuum roll shell of roll 218 may be in the range of between 25 mm and 75 mm. The mean airflow through web 212 in the area of suction zones Z1 and Z2 can be approximately 150 $m^3$/min per meter machine width. Fabric 214, web 212 and dewatering fabric 220 are guided through a belt press 222 formed by vacuum roll 218 and a permeable belt 234. As is shown in FIG. 28, permeable belt 234 is a single endlessly circulating belt, which is guided by a plurality of guide rolls and which presses against vacuum roll 218 so as to form belt press 122. To control and/or adjust the tension of belt 234, one of the guide rolls may be a tension adjusting roll. This arrangement also includes a pressing device arranged within belt 234. The pressing device includes a journal bearing JB, one or more actuators A, and one or more pressing shoes PS which are preferably perforated.

The circumferential length of at least vacuum zone Z2 can be between approximately 200 mm and approximately 2500 mm, and is preferably between approximately 800 mm and approximately 1800 mm, and an even more preferably between approximately 1200 mm and approximately 1600 mm. The solids leaving vacuum roll 218 in web 212 will vary between approximately 25% to approximately 55% depending on the vacuum pressures and the tension on permeable belt 234 and the pressure from the pressing device PS/A/JB as well as the length of vacuum zone Z2, and the dwell time of web 212 in vacuum zone Z2. The dwell time of web 212 in vacuum zone Z2 is sufficient to result in this solids range of between approximately 25% to approximately 55%.

Figure 29:
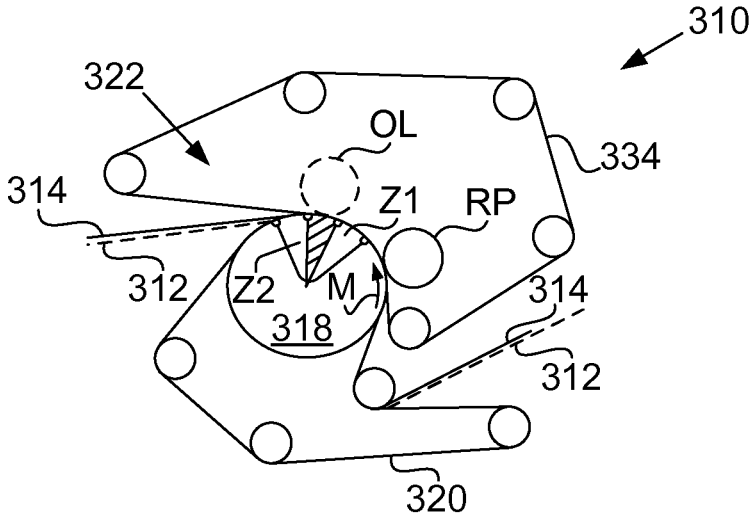
FIG. 29 is a cross-sectional schematic diagram of still another advanced dewatering system with an embodiment of a belt press, which uses a press roll according to the present invention.

FIG. 29 shows another advanced dewatering system 310 for processing a fibrous web 312. System 310 includes an upper fabric 314, a vacuum roll 318, a dewatering fabric 320 and a belt press assembly 322. Other optional features which are not shown include a hood (which may be a hot air hood), one or more Uhle boxes, one or more shower units, one or more savealls, and one or more heater units, as is shown in FIGS. 9 and 20. Fibrous material web 312 enters system 310 generally from the right as shown in FIG. 29. Fibrous web 312 is a previously formed web (i.e., previously formed by a mechanism not shown) that is placed on fabric 314. As was the case in FIG. 9, a suction device (not shown but similar to device 16 in FIG. 9) can provide suctioning to one side of web 312, while the suction roll 318 provides suctioning to an opposite side of web 312.

Fibrous web 312 is moved by fabric 314, which can be a TAD fabric, in a machine direction M past one or more guide rolls. Although it may not be necessary, before reaching suction roll 318, web 212 may have sufficient moisture is removed from web 212 to achieve a solids level of between approximately 15% and approximately 25% on a typical or nominal 20 gram per square meter (gsm) web running. This can be accomplished by vacuum at a box (not shown) of between approximately −0.2 to approximately −0.8 bar vacuum, with a preferred operating level of between approximately −0.4 to approximately −0.6 bar.

As fibrous web 312 proceeds along machine direction M, it comes into contact with a dewatering fabric 320. Dewatering fabric 320 (which can be any type described herein) can be endless circulating belt, which is guided by a plurality of guide rolls and is also guided around a suction roll 318. Web 312 then proceeds toward vacuum roll 318 between fabric 314 and dewatering fabric 320. Vacuum roll 318 can be a driven roll which rotates along machine direction M and is operated at a vacuum level of between approximately −0.2 to approximately −0.8 bar with a preferred operating level of at least approximately −0.4 bar. By way of non-limiting example, the thickness of the vacuum roll shell of roll 318 may be in the range of between 25 mm and 50 mm. The mean airflow through web 312 in the area of suction zones Z1 and Z2 can be approximately 150 $m^3$/min per meter machine width. Fabric 314, web 312 and dewatering fabric 320 are guided through a belt press 322 formed by vacuum roll 318 and a permeable belt 334. As is shown in FIG. 29, permeable belt 334 is a single endlessly circulating belt, which is guided by a plurality of guide rolls and which presses against vacuum roll 318 so as to form belt press 322. To control and/or adjust the tension of belt 334, one of the guide rolls may be a tension adjusting roll. This arrangement also includes a pressing roll RP arranged within belt 334. Pressing device RP can be press roll and can be arranged either before zone Z1 or between the two separated zones Z1 and Z2 at optional location OL.

The circumferential length of at least vacuum zone Z1 can be between approximately 200 mm and approximately 2500 mm, and is preferably between approximately 800 mm and approximately 1800 mm, and an even more preferably between approximately 1200 mm and approximately 1600 mm. The solids leaving vacuum roll 318 in web 312 will vary between approximately 25% to approximately 55% depending on the vacuum pressures and the tension on permeable belt 334 and the pressure from pressing device RP as well as the length of vacuum zone Z1 and also Z2, and the dwell time of web 312 in vacuum zones Z1 and Z2. The dwell time of web 312 in vacuum zones Z1 and Z2 is sufficient to result in this solids range of between approximately 25% to approximately 55%.

The arrangements shown in FIGS. 28 and 29 have the following advantages: if a very high bulky web is not required, this option can be used to increase dryness and therefore production to a desired value, by adjusting carefully the mechanical pressure load. Due to the softer second fabric 220 or 320, web 212 or 312 is also pressed at least partly between the prominent points (valleys) of the three-dimensional structure 214 or 314. The additional pressure field can be arranged preferably before (no re-wetting), after, or between the suction area. Upper permeable belt 234 or 334 is designed to resist a high tension of more than approximately 30 KN/m, and preferably approximately 50 KN/m, or higher e.g., approximately 80 KN/M. By utilizing this tension, a pressure is produced of greater than approximately 0.5 bars, and preferably approximately 1 bar, or higher, may be e.g., approximately 1.5 bar. The pressure "p" depends on the tension "S" and the radius "R" of suction roll 218 or 318 according to the well known equation, p=S/R. Upper belt 234 or 334 can also be a stainless steel and/or a metal band and/or polymeric band. Permeable upper belt 234 or 334 can be made of a reinforced plastic or synthetic material. It can also be a spiral linked fabric. Preferably, belt 234 or 334 can be driven to avoid shear forces between first fabric 214 or 314, second fabric 220 or 320 and web 212 or 312. Suction roll 218 or 318 can also be driven. Both of these can also be driven independently.

Permeable belt 234 or 334 can be supported by a perforated shoe PS for providing the pressure load.

The airflow can be caused by a non-mechanical pressure field as follows: with an underpressure in a suction box of the suction roll (118, 218 or 318) or with a flat suction box SB (see FIG. 25). It can also utilize an overpressure above the first surface of the pressure producing element 134, PS, RP, 234 and 334 by, e.g., by hood 124 (although not shown, a hood can also be provided in the arrangements shown in FIGS. 25, 28 and 29), supplied with air, e.g., hot air of between approximately 50 degrees C. and approximately 180 degrees C., and preferably between approximately 120 degrees C. and approximately 150 degrees C., or also preferably steam. Such a higher temperature is especially important and preferred if the pulp temperature out of the headbox is less than about 35 degrees C. This is the case for manufacturing processes without or with less stock refining. Of course, all or some of the above-noted features can be combined to form advantageous press arrangements.

The pressure in the hood can be less than approximately 0.2 bar, preferably less than approximately 0.1, most preferably less than approximately 0.05 bar. The supplied air flow to the hood can be less or preferable equal to the flow rate sucked out of the suction roll 118, 218, or 318 by vacuum pumps.

Suction roll 118, 218 and 318 can be wrapped partly by the package of fabrics 114, 214, or 314 and 120, 220, or 320, and the pressure producing element, e.g., belt 134, 234, or 334, whereby the second fabric e.g., 220, has the biggest wrapping arc "a2" and leaves the larger arc zone Z1 lastly (see FIG. 28). Web 212 together with first fabric 214 leaves secondly (before the end of the first arc zone Z2), and the pressure producing element PS/234 leaves firstly. The arc of the pressure producing element PS/234 is greater than an arc of the suction zone arc "a2". This is important, because at low dryness, the mechanical dewatering is more efficient than dewatering by airflow. The smaller suction arc "a1" should be big enough to ensure a sufficient dwell time for the air flow to reach a maximum dryness. The dwell time "T" should be greater than approximately 40 ms, and preferably is greater than approximately 50 ms. For a roll diameter of approximately 1.2 mm and a machine speed of 1200 m/min, the arc "a1" should be greater than approximately 76 degrees, and preferably greater than approximately 95 degrees. The formula is a1=[dwell time*speed*360/circumference of the roll].

Second fabric 120,220, 320 can be heated e.g., by steam or process water added to the flooded nip shower to improve the dewatering behavior. With a higher temperature, it is easier to get the water through felt 120, 220, 320. Belt 120, 220, 320 could also be heated by a heater or by the hood, e.g., 124. TAD-fabric 114, 214, 314 can be heated especially in the case when the former of the tissue machine is a double wire former. This is because, if it is a crescent former, TAD fabric 114, 214, 314 will wrap the forming roll and will therefore be heated by the stock, which is injected by the headbox.

There are a number of advantages of the process using any of the herein disclosed devices such as. In the prior art TAD process, ten vacuum pumps are needed to dry the web to approximately 25% dryness. On the other hand, with the advanced dewatering systems of the invention, only six vacuum pumps are needed to dry the web to approximately 35%. Also, with the prior art TAD process, the web must be dried up to a high dryness level of between about 60 and about 75%, otherwise a poor moisture cross profile would be created. The systems of the instant invention make it possible to dry the web in a first step up to a certain dryness level of between approximately 30% to approximately 40%, with a good moisture cross profile. In a second stage, the dryness can be increased to an end dryness of more than approximately 90% using a conventional Yankee dryer combined the inventive system. One way to produce this dryness level, can include more efficient impingement drying via the hood on the Yankee.

The instant application expressly incorporates by reference the entire disclosure of U.S. patent application Ser. No. 10/972,431 entitled PRESS SECTION AND PERMEABLE BELT IN A PAPER MACHINE in the name of Jeffrey HERMAN et al.

The entire disclosure of U.S. patent application Ser. No. 10/768,485 filed on Jan. 30, 2004 is hereby expressly incorporated by reference in its entirety.

It is noted that the foregoing examples have been provided merely for the purpose of explanation and are in no way to be construed as limiting of the present invention. While the present invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A permeable belt for use in a system for dewatering and/or drying a fibrous web, the permeable belt capable of being subjected to a tension of at least approximately 30 kN/m, the permeable belt having at least one side having an open area of at least approximately 25% and a contact area of at least approximately 10%.

2. The permeable belt of claim 1, wherein said contact area is at least approximately 25%.

3. The permeable belt of claim 1, wherein the permeable belt has through openings.

4. The permeable belt of claim 1, wherein the permeable belt includes through openings arranged in a generally regular symmetrical pattern.

5. The permeable belt of claim 1, wherein the permeable belt includes generally parallel rows of through openings, said rows being oriented along a machine direction.

6. The permeable belt of claim 1, wherein the permeable belt includes through openings and a plurality of grooves, each of said plurality of grooves intersecting a different set of through openings.

7. The permeable belt of claim 6, wherein each of said plurality of grooves includes a width, each of said through openings includes a diameter, said diameter being greater than said width.

8. The permeable belt of claim 1, wherein the permeable belt includes a flexible spiral link fabric.

9. The permeable belt of claim 8, wherein said spiral link fabric includes a synthetic material.

10. The permeable belt of claim 8, wherein said spiral link fabric includes stainless steel.

11. The permeable belt of claim 1, wherein the permeable belt is woven.

12. A system of fabrics for dewatering and/or drying a fibrous web, comprising:

a permeable dewatering fabric including a felt with a batt layer; and a structured fabric, the fibrous web being carried between said structured fabric and said permeable dewatering fabric, said permeable dewatering fabric including a vector layer having fibers which are equal to or greater than approximately 67 dtex.

13. The system of claim 12, wherein said structured fabric is one of a woven fabric, a through air drying fabric, a membrane, a fabric, a printed membrane and a printed fabric.

14. The system of claim 12, wherein said permeable dewatering fabric has a compressibility that is greater than a compressibility of said structured fabric.

15. The system of claim 12, wherein said permeable dewatering fabric has a resilience that is greater than a resilience of said structured fabric.

16. The system of claim 12, wherein said structured fabric has a roughness that is coarser than a roughness of said permeable dewatering fabric.

* * * * *